US009972460B2

(12) United States Patent
Iwamoto et al.

(10) Patent No.: US 9,972,460 B2
(45) Date of Patent: May 15, 2018

(54) CONNECTOR AND SWITCH

(71) Applicants: FUJITSU COMPONENT LIMITED, Tokyo (JP); NTT FACILITIES, INC., Tokyo (JP)

(72) Inventors: Daiei Iwamoto, Tokyo (JP); SeungSeok Beak, Tokyo (JP); Takashi Yuba, Tokyo (JP); Koichi Kiryu, Nagano (JP); Keiichi Hirose, Tokyo (JP); Masatoshi Noritake, Tokyo (JP)

(73) Assignees: FUJITSU COMPONENT LIMITED, Tokyo (JP); NTT FACILITIES, INC., Tokyo (JP)

( * ) Notice: Subject to any disclaimer, the term of this patent is extended or adjusted under 35 U.S.C. 154(b) by 0 days. days.

(21) Appl. No.: 14/944,415

(22) Filed: Nov. 18, 2015

(65) Prior Publication Data

US 2016/0071663 A1 Mar. 10, 2016

Related U.S. Application Data

(63) Continuation of application No. 13/884,688, filed as application No. PCT/JP2011/066308 on Jul. 19, 2011, now Pat. No. 9,225,125.

(30) Foreign Application Priority Data

Nov. 12, 2010 (JP) ..... 2010-254259

(51) Int. Cl.
*H01R 33/96* (2006.01)
*H01H 13/14* (2006.01)
(Continued)

(52) U.S. Cl.
CPC ..... *H01H 13/14* (2013.01); *H01H 1/5866* (2013.01); *H01H 15/16* (2013.01);
(Continued)

(58) Field of Classification Search
CPC .. H01H 13/14; H01H 2205/002; H01H 15/16; H01H 1/5866; H01R 24/30; H01R 24/78
(Continued)

(56) References Cited

U.S. PATENT DOCUMENTS 2,473,848 A 6/1949 Baxter
3,648,004 A 3/1972 Williams, III
(Continued)

FOREIGN PATENT DOCUMENTS

EP 1734548 12/2006
GB 1127673 9/1968
JP H05-082208 4/1993
(Continued)

OTHER PUBLICATIONS

International Search Report dated Oct. 4, 2011.

*Primary Examiner* — Edwin A. Leon
*Assistant Examiner* — Lheiren Mae A Caroc
(74) *Attorney, Agent, or Firm* — IPUSA, PLLC

(57) ABSTRACT

A connector includes a fixed contact, a movable contact that contacts with the fixed contact, a slide, a contact slide operated in association with a movement of the slide, a button that is pushed in accordance with the movement of the slide, the button including a lower portion, an upper portion, and a slant portion connecting the lower portion to an upper stage, and a card that moves the movable contact toward and away from the fixed contact in accordance with the movement of the button, wherein the contact slide contacts with the lower portion when the switch is in a turn-off state, contacts with the slant portion so as to push the button and cause the card to move the movable contact toward the fixed contact when the slide slides in one direction, and contacts with the upper portion when the switch is in a turn-on state.

6 Claims, 41 Drawing Sheets

(51) Int. Cl.

| | |
|---|---|
| ***H01R 13/70*** | (2006.01) |
| ***H01H 1/58*** | (2006.01) |
| ***H01H 15/16*** | (2006.01) |
| *H01R 103/00* | (2006.01) |
| *H01R 24/78* | (2011.01) |

(52) U.S. Cl.
CPC ..... *H01R 13/70* (2013.01); *H01H 2205/002* (2013.01); *H01R 24/78* (2013.01); *H01R 2103/00* (2013.01)

(58) Field of Classification Search
USPC ..... 200/50.12, 520, 547, 330, 337
See application file for complete search history.

(56) References Cited

U.S. PATENT DOCUMENTS

| | | | | |
|---|---|---|---|---|
| 5,270,505 | A | 12/1993 | Magiera | |
| 5,575,380 | A | 11/1996 | Imai | |
| 7,049,538 | B2 * | 5/2006 | Camillo | H01H 23/162 200/339 |
| 7,211,758 | B2 | 5/2007 | Lui | |
| 9,225,125 | B2 * | 12/2015 | Iwamoto | H01R 13/70 |
| 2008/0053809 | A1 * | 3/2008 | Shimazu | H01H 3/46 200/530 |
| 2010/0029111 | A1 | 2/2010 | Yuba et al. | |

FOREIGN PATENT DOCUMENTS

| | | |
|---|---|---|
| JP | 3009365 U | 4/1995 |
| JP | 2003-031301 | 1/2003 |
| JP | 2010-257601 | 11/2010 |

* cited by examiner

CONNECTOR AND SWITCH

CROSS-REFERENCE TO RELATED APPLICATIONS

This application is a continuation application of and is claiming benefit of priority under 35 U.S.C. 120 to patent application Ser. No. 13/884,688 filed on May 10, 2013, which has effectively entered under 35 U.S.C. 371 (c) the national stage from PCT Application No. PCT/JP2011/066308 filed on Jul. 19, 2011, which claims the benefit of priority to Japanese Priority Patent Application No. 2010-254259 filed on Nov. 12, 2010, where the entire contents of all of these applications are incorporated herein by reference.

BACKGROUND

Field

The present invention relates to a connector and a switch.

Description of the Related Art

Generally, an electric apparatus is activated by electric power supplied from an electric power source. Ordinarily, the electric power is supplied to the electric apparatus from the power source via a connector. As disclosed in Patent Documents 1 and 2, for example, such connector enables an electrical connection in a manner that a male type connector in a convex shape is engaged with a female type connector in a concave shape.

Meanwhile, as a countermeasure against global warming or the like in recent years, a high voltage and direct current electric power supply is reviewed because power loss is small in voltage conversion, electric power transmission, or the like. Especially, such direct current power supply may be desirable in an information apparatus such as a server since the information apparatus may consume great electric power.

As to the electric power supplied to the electric apparatus, there is a case where a human body is influenced or an operation of electronic parts is influenced.

As an operator works on an installation or maintenance of the information apparatus, when such high voltage electric power is used in the information apparatus such as a server, a connector for an electrical connection is desirable to be a type different from a connector used for alternate-current commercial power supply.

For example, a connector in which a currently used switch is assembled cannot be used without modification in a case where a voltage becomes 100 V or greater or a high voltage direct current is used. In a case where electric power supplied from the power source is a direct current of 400 V, because sufficient safety or reliability is not assured in a switch used for a currently used alternate current (AC) 100 V, the use of the currently used switch may cause danger.

[Patent Document 1] Japanese Laid-open Patent Publication No. Hei 5-82208

[Patent Document 2] Japanese Unexamined Patent Application Publication No. 2003-31301

SUMMARY

According to an aspect of the present invention, there is provided a connector including a connection terminal to be connected to another connection terminal of another connector; a fixed contact; a movable contact being capable of contacting the fixed contact; a slide portion; a contact slide operated in association with a slide movement of the slide portion; a button that is pushed in accordance with the slide movement of the slide portion, the button including a lower portion, an upper portion having a profile relatively higher than the lower portion, and a slant portion connecting the lower portion to an upper stage provided on its upper surface; and a card that moves the movable contact toward and away from the fixed contact in accordance with the movement of the button; wherein a tip end of the contact slide contacts with the lower portion when the switch is in a turn-off state in which the movable contact is separated from the fixed contact, contacts with the slant portion so as to push the button and cause the card to move the movable contact toward the fixed contact when the slide portion is slide in one direction, and contacts with the upper portion when the switch is in a turn-on state in which the movable contact contacts with the fixed contact.

DESCRIPTION OF EMBODIMENTS

A description of embodiments of the present invention is given below, with reference to the FIG. 1 through FIG. 44. The same reference symbols are attached to the same parts and description of these parts may be omitted.

First Embodiment (Structure of Connectors)

The structure of the connector of a first embodiment is described. The connector of the first embodiment is connected to another connector being a plug connector illustrated in FIGS. 1 to 5. The connector of the first embodiment corresponds to a jack connector having a structure illustrated in FIGS. 6 to 8. Hereinafter, the plug connector illustrated in FIGS. 1 to 5 and the jack connector illustrated in FIGS. 6 to 8 may be collectively referred to as a connector.

Figure 1:
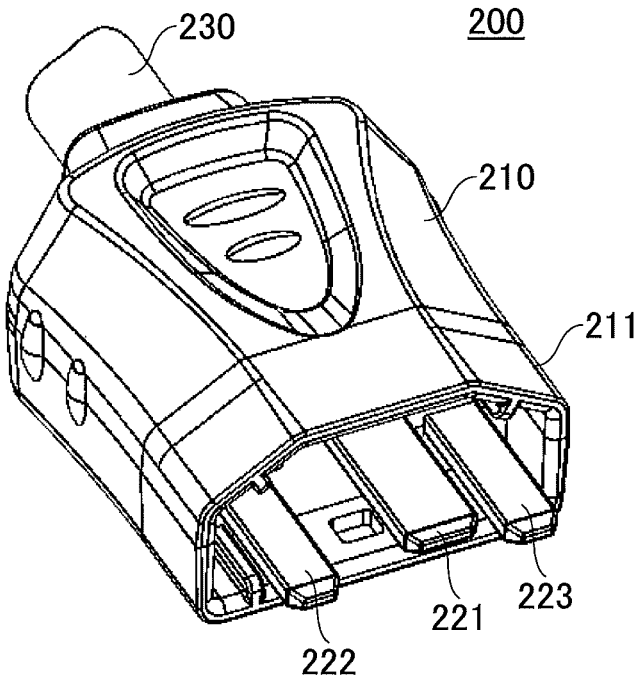
FIG. 1 is a perspective view of a plug connector of a first embodiment.
Figure 2:
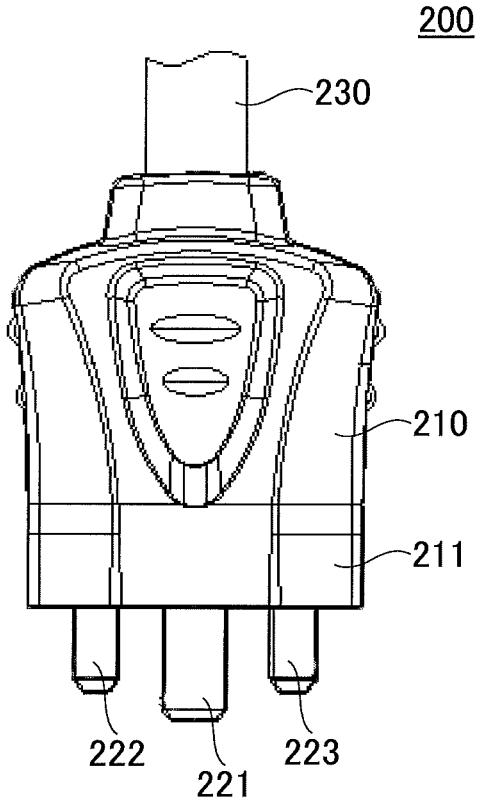
FIG. 2 is a plan view of the plug connector of the first embodiment.
Figure 3:
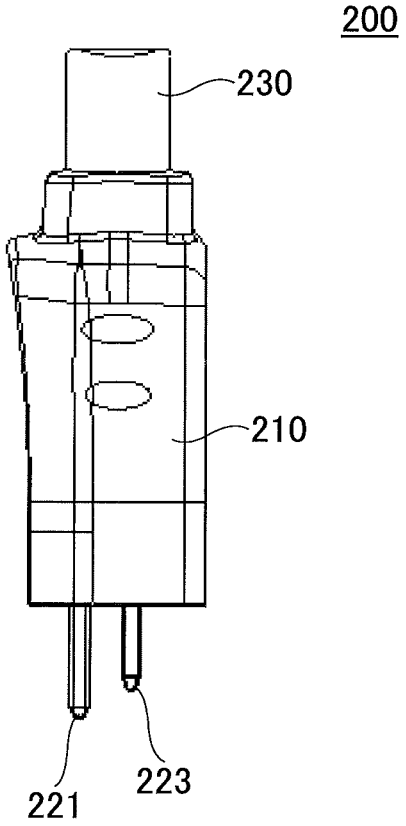
FIG. 3 is a side view of the plug connector of the first embodiment.
Figure 4:
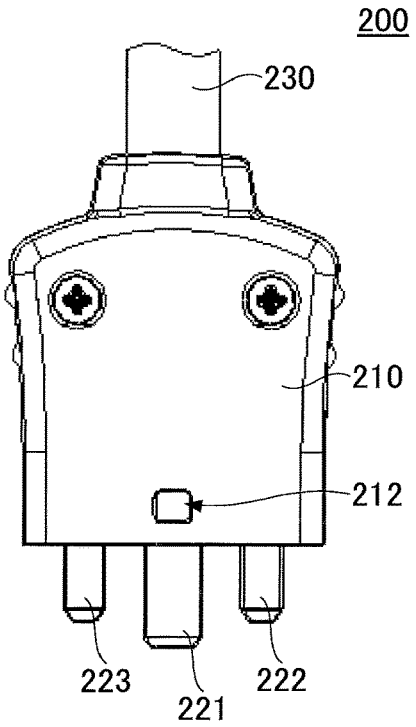
FIG. 4 is a bottom view of the plug connector of the first embodiment.
Figure 5:
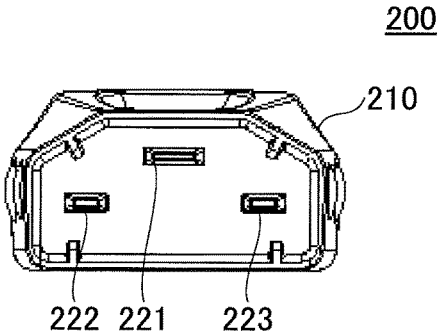
FIG. 5 is a front view of the plug connector of the first embodiment.

Firstly, referring to FIGS. 1 to 5, a plug connector 200 is explained. FIG. 1 is a perspective view of the plug connector 200. FIG. 2 is a plan view of the plug connector 200. FIG. 3 is a side view of the plug connector 200. FIG. 4 is a bottom view of the plug connector 200. FIG. 5 is a front view of the plug connector 200. The plug connector 200 includes a cover portion 210 formed by insulating material or the like and three plug terminals 221, 222, and 223, which are examples of other connection terminals. On a side opposite to the side where the three plug terminals 221, 222, and 223 are provided, a power supply cable 230 is connected. The plug terminal 221 is a ground (GND) terminal, which is longer than the plug terminals 222 and 223. Electric power is supplied to the plug and jack connectors when the plug terminals 222 and 223 are electrically connected. The plug connector 200 includes a protecting portion 211 formed in a shape that covers the plug terminals 221, 222, and 223 in the cover portion 210 on a side provided with the plug terminals 221, 222, and 223. Further, a connector connection hole 212 is provided so that connector connection is not released after the plug connector 200 is connected to the connector of the first embodiment are connected.

Figure 6:
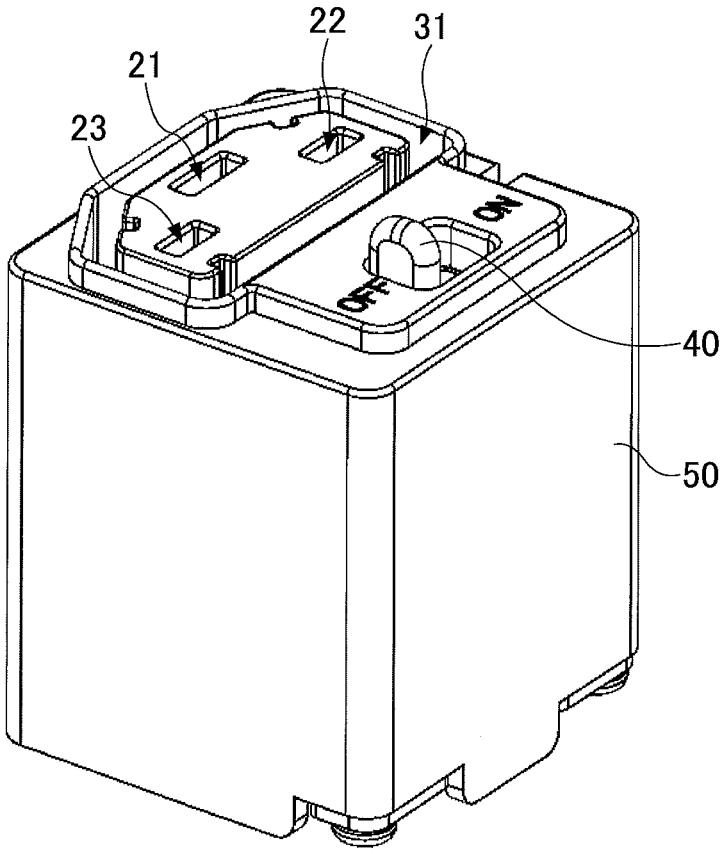
FIG. 6 is a perspective view of a connector of the first embodiment.
Figure 7:
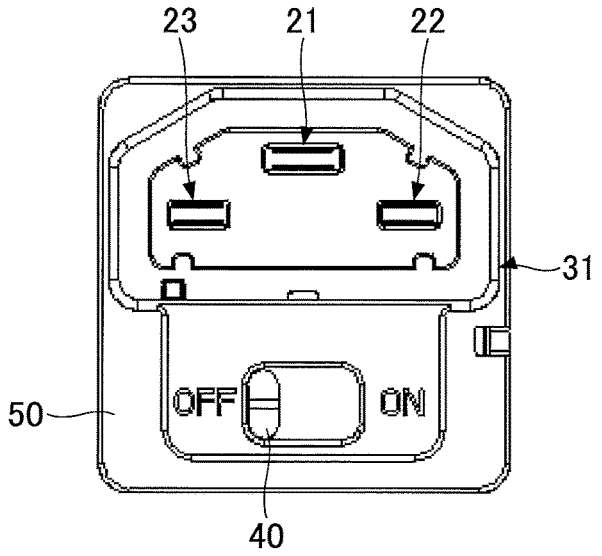
FIG. 7 is a front view of the connector of the first embodiment.
Figure 8:
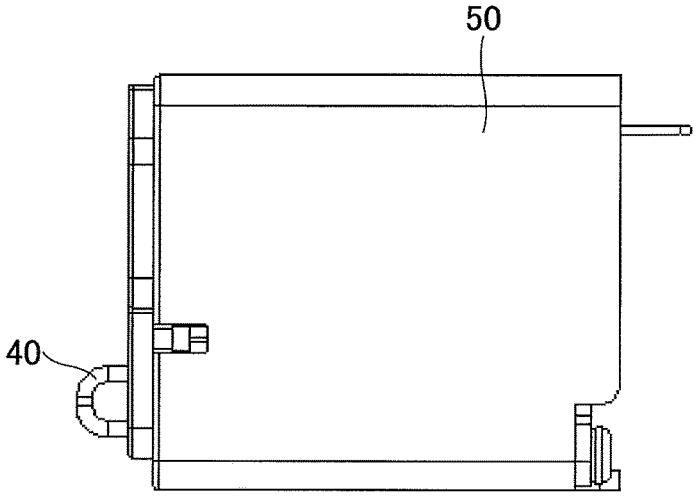
FIG. 8 is a side view of the connector of the first embodiment.

Next, referring to FIGS. 6 to 8, the connector of the first embodiment is described. FIG. 6 is a perspective view of a connector of the first embodiment. FIG. 7 is a front view of the connector. FIG. 8 is a side view of the connector. The connector of the first embodiment is entirely covered by a casing 50 and includes jack openings 21, 22, and 23 into which plug terminals 221, 222, and 223 of the plug connector 200 are inserted, a groove portion 31 into which the protecting portion 211 of the plug connector 200 is inserted, and a slide operating portion 40 for controlling whether electric power is supplied while the plug connector is connected to the connector of the first embodiment. The slide operation portion 40 can be slide into a position of "ON" or a position of "OFF". By sliding the slide operating portion 40, it is possible to control whether to supply electric power via the connector.

Figure 9:
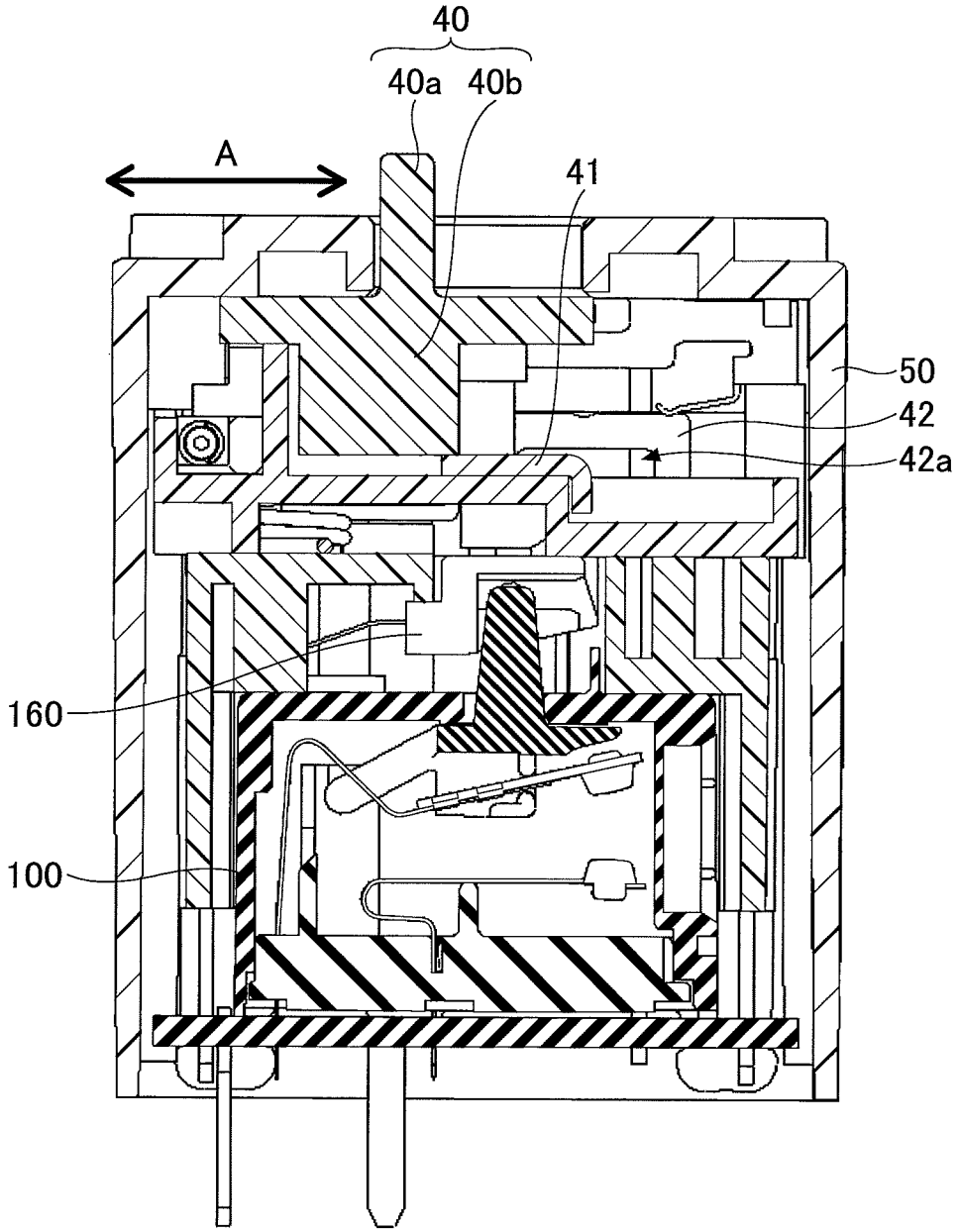
FIG. 9 is an internal structural view of the connector of the first embodiment.

Referring to FIG. 9, the internal structure of the connector of the first embodiment is described in detail. FIG. 9 is a cross-sectional view for illustrating an internal structure of the connector of the first embodiment. The connector of the first embodiment is shaped such that the upper slide operating portion 40*a* of the slide operating portion 40 outwardly protrudes from an opening provided in the casing 50. By moving the upper slide operating portion 40*a* in a sliding direction indicated by an arrow A from the outside of the casing 50, it is possible to operate whether to electrically connect a switch portion 100 located inside the casing 50.

The slide operating portion 40 has a main slide operating portion 40*b* positioned inside the casing 50. The main slide operating portion 40*b* is connected to a slide linking portion 41. The slid linking portion 41 is operated substantially in parallel to the sliding direction indicated by arrows A. The slide linking portion 41 is shaped like a letter of L. One end of the slide linking portion 41 intrudes inside a contact slide opening portion 42*a* of a contact slide portion 42. The contact slide opening portion 42*a* is formed to be an elongated shape along a moving direction of the slide linking portion 41, namely in the direction of the arrows A. As described later, a contact slide contacting portion extending in a direction substantially perpendicular to the sliding direction indicated by the arrows A is provided in the contract slide portion 42. The tip end of the contact slide contacting portion contacts the upper surface of the button 160 of the switch portion 100.

(Switch Portion)

Figure 10:
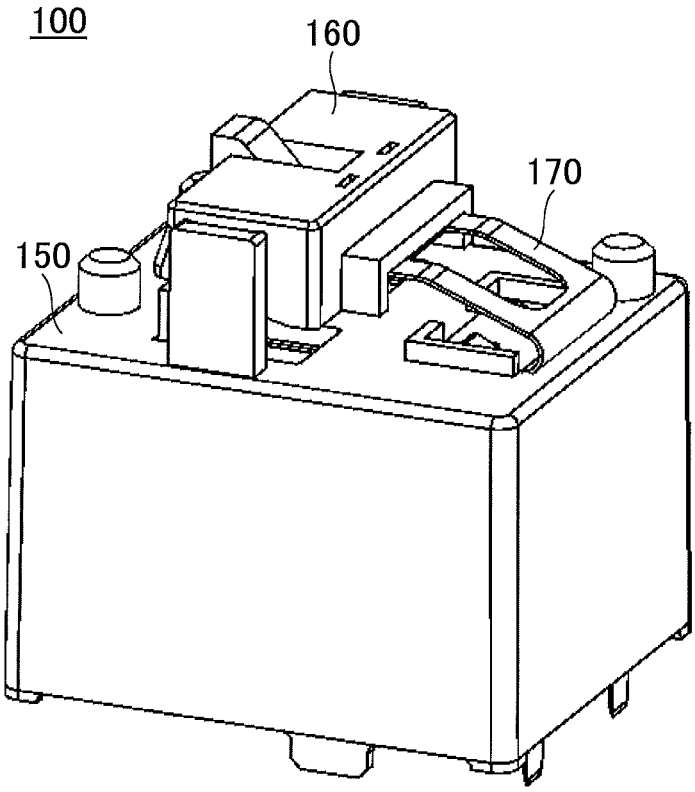
FIG. 10 is a perspective view of a switch.
Figure 11:
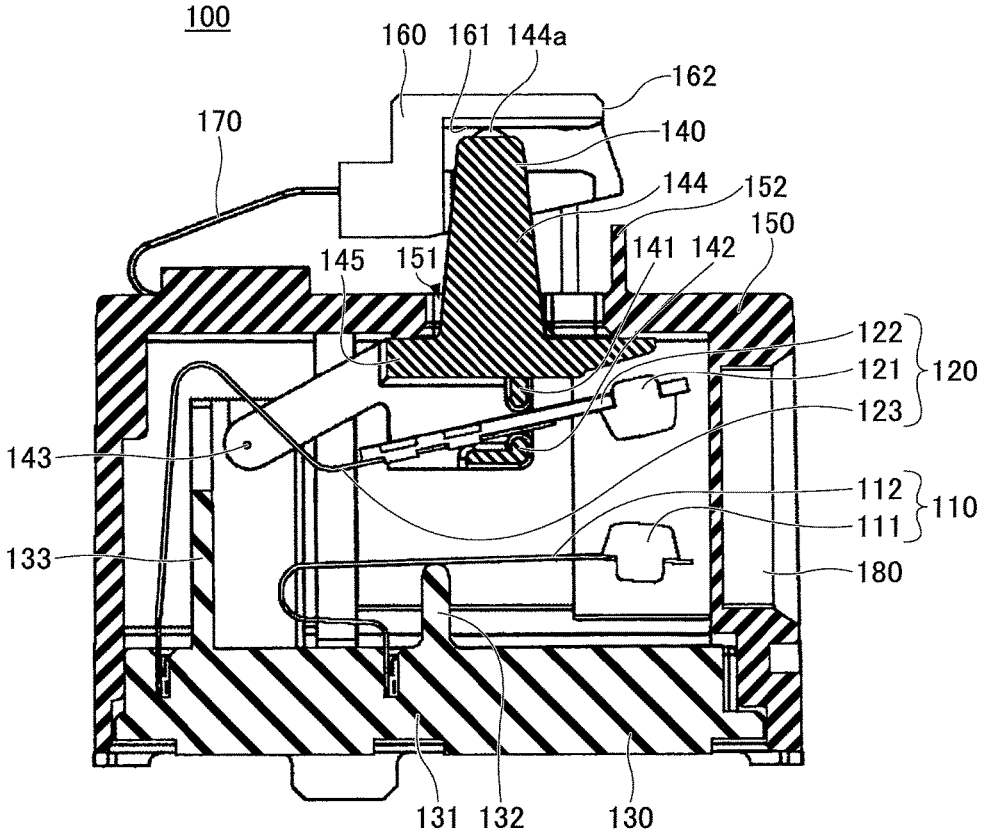
FIG. 11 is a structural view of the switch in a turn-off state.

Next, a switch portion 100 is described. The switch portion 100 of the connector of the first embodiment is to control supply of electric power. The switch portion 100 is referred to as a power source switch. FIG. 10 is a perspective view of the switch portion 100. FIG. 11 is an internal structural view of the switch portion 100. Referring to FIG. 11, the switch portion 100 can control turning on or turning off the supply of electric power source depending on whether a fixed contact 111 of a fixed portion 110 contacts a movable contact 121 of a movable portion 120.

The fixed portion 110 is entirely made of conductive material such as a metal. The fixed contact 111 capable of contacting the movable contact 121 of the movable portion 120 is provided in an end portion of the fixed spring 112. The fixed spring 112 is formed by bending a metallic plate made of copper, an alloy containing copper, or the like. The fixed contact 111 is made of an alloy containing silver and copper. Another end portion of the fixed spring 112 is fixed to a main base block 131 in the base block 130, and is supported by a fixing portion supporter 132 in a middle of the fixed spring 112.

The movable portion 120 is entirely formed by conductive material such as a metal. The movable contact 121 capable of contacting the fixed contact 111 of the fixed portion 110 is provided in one end portion of the movable plate 122, and another end portion of the movable plate 122 is connected to one end portion of a movable spring 123. The movable plate 122 and the movable spring 123 are formed by bending a metallic plate made of copper, an alloy containing copper, or the like. The movable contact 121 is made of an alloy containing silver and copper. The other end portion of the movable spring 123 is fixed to the main base block 131 of the base block 130. However, because the movable spring 123 is formed by bending a metallic plate or the like, the movable spring 123 has flexibility. Therefore, the movable contact 121 provided in the one end portion of the movable plate 122 can be moved up and down. Further, in the base block 130, an insulating wall 133 made of flame resistant resin material or the like is provided between a portion of the base block 130 where the other end portion of the fixed spring 112 is connected and a portion of the base block 130 where the other end portion of the movable spring 123 is connected. The movable spring 123 is bent so as to surround a part of the periphery of the insulating wall 133 from the other end portion.

The upper surface of the movable plate 122 of the movable portion 120 contacts an upper contact part 141 of a card 140, which is an example of a first contact portion. The lower surface of the movable plate 122 of the movable portion 120 contacts a lower contact part 142 of the card 140 which is an example of a second contact portion. Under this state, by rotating the card 140 around a rotating shaft 143, force is applied to the movable plate 122 by a contact of the movable plate 122 with the upper contact part 141 or the lower contact part 142, and the movable contact 121 can be upwardly or downwardly moved. Because the upper contact part 141 and the lower contact part 142 slide on the movable plate 122, a surface layer made of a fluorine resin may be formed on the surfaces of the upper contact part 141 and the lower contact part 142 in order to reduce a friction resistance.

The fixed portion 110 and the movable portion 120 are installed inside an area surrounded by the base block 130 and a switch case 150. The card 140 includes a protruding portion 144 outwardly protruding from the switch opening 151 which is provided in the switch case 150, and a card main body 145 positioned inside the area surrounded by the base block 130 and the switch case 150. Therefore, in the switch portion 100, the upper contact part 141 and the lower contact part 142 is provided inside the area surrounded by the base block 130 and the switch case 150. Further, the card 140, the base block 130, and the switch case 150 are formed by insulating material made of resin material or the like.

A button 160 to rotate the card 140 around the rotating shaft 143 is provided outside the switch case 150. The card 140 contacts a button inner portion 161 of the button 160 at a contact portion **144*a* provided at the upper portion of the protruding portion 144 of the card 140. Because the contact portion 144*a* slides on the surface of the button inner portion 161, a surface layer made of a fluorine resin or the like may be formed on the surface of the button inner portion 161 in order to reduce the friction resistance. Further, a swing spring 170 is provided outside the switch case 150. One end of the swing spring 170 is connected to the switch case 150 and the other end of the swing spring 170 is connected to the button 160**.

(ON and OFF Operations in Switch Portion)

Figure 12:
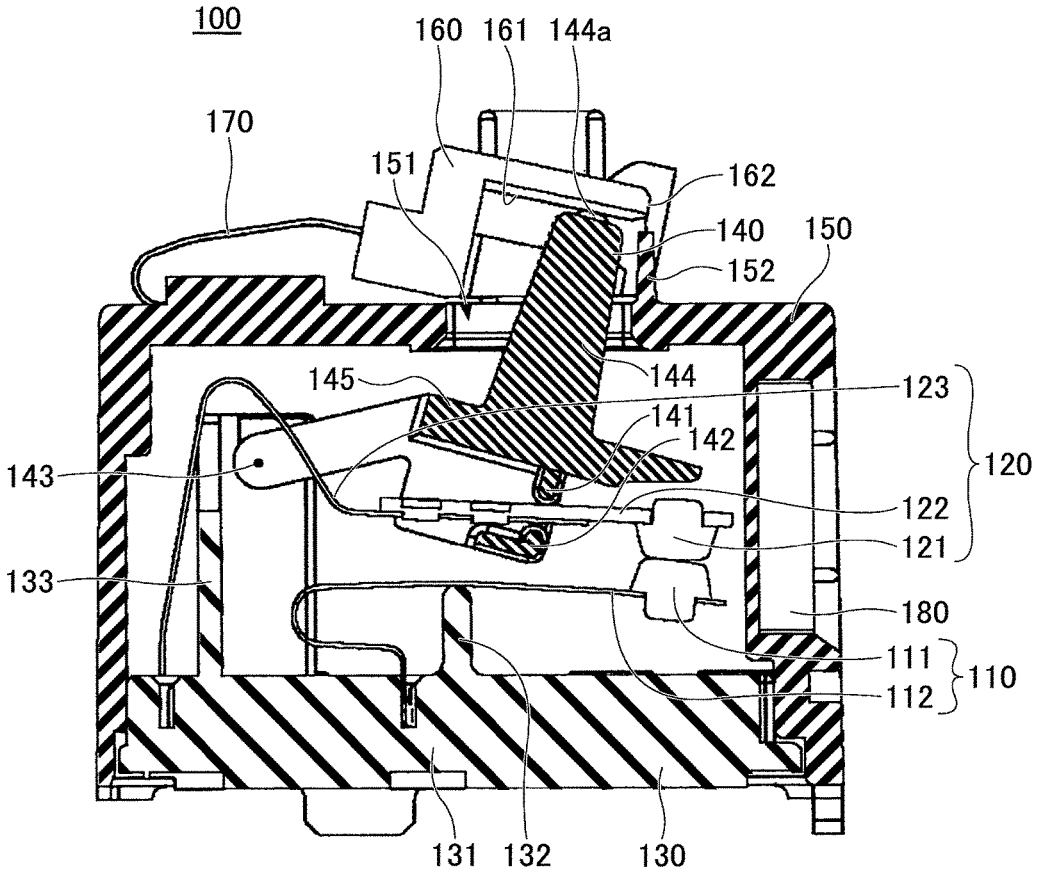
FIG. 12 is a structural view of the switch in a turn-on state.

In the switch portion 100, when the switch will be turned on, a contact slide contacting portion of the contact slide portion 42 is moved as described later. When the contact slide contacting portion is moved, the button 160 is pushed down to push the card 140 whose contact portion **144*a* contacts the button inner portion 161 of the button. Therefore, the card 140 rotates along the rotating shaft 143. As described, force is downwardly applied to the movable plate 122 of the movable portion 120 via the upper contact part 141 to cause the movable contact 121 to contact the fixed contact 111. This state is illustrated in FIG. 12. As described later, because this state of the switch portion 100 is maintained by the contact slide contacting portion of the contact slide portion 42, a contact between the movable contact 121 and the fixed contact 111** is maintained to enable the power source to supply the electric power.

In the switch portion 100, when the switch will be turned off, the contact slide contacting portion of the contact slide portion 42 is moved to return the button 160 to the turn-off state by restoring force of the swing spring 170. Said differently, as illustrated in FIG. 11, the card 140 in contact with the button inner portion 161 of the button 160 at the contact portion **144*a* is rotated around the rotating shaft 143. Force is upwardly applied to the movable plate 122 of the movable portion 120 via the lower contact part 142. As described, it becomes possible to cancel the contact between the movable contact 121 and the fixed contact 111 by the upward force applied to the movable plate 122 and the electric power supply from the electric power source stops. At this time, arc may be generated between the movable contact 121 and the fixed contact 111. In order to disperse the arc by force of a magnetic field, a permanent magnet 180 for generating a magnetic field in a direction substantially perpendicular to the direction of generating the arc is provided in the vicinity of the position where the movable contact 121 contacts the fixed contact 111**.

When the electric power supply from the electric power source is shut down, instead of using the restoring force of the movable spring 123 of the movable portion 120 or the like, the restoring force of the swing spring 170 provided outside the switch case 150 is used to change the switch portion 100 into the turn-off state. Therefore, in a case where the movable spring 123 of the movable portion 120 or the like does not have restoring force, the electric power source can be turned off. Further, if a part of the movable spring 123 or the like is molten by heat and the function as the spring is lost in the movable spring 123, the electric power source is made the turned-off state by spring property of the swing spring 170, without using the restoring force of the movable spring 123. Thus, the electric power supply from the electric power source can be securely shut down. Further, because the swing spring 170 is installed outside the switch case 150, the swing spring 170 is not influenced by heat or the like unlike the fixed portion 110 and the movable portion 120, which can be influenced by heat or the like inside the switch case 150.

Further, in the base block 130 of the switch portion 100, the insulating wall 133 is provided between the portion to which the other end portion of the fixed spring 112 is connected and the portion to which the other end portion of the movable spring 123 is connected. With this, if the fixed portion 110 and the movable portion 120 are progressively molten by heat, a molten portion of the fixed portion and a molten portion of the movable portion are separated by the insulating wall 133. Therefore, it is possible to avoid a continuous short circuit of an electric current between the molten fixed and movable portions 110 and 120 while the molten fixed and movable portions 110 and 120 are attached to each other.

In the switch portion 100, if a dust or the like intrudes into an area surrounded by the base block 130 and the switch case 150, a short circuit or a contact failure between the fixed contact 111 and the movable contact 121 may be caused. Therefore, in the turn-off state of the switch portion 100, in order to prevent the dust or the like from intruding into the area surrounded by the base block 130 and the switch case 150, the upper surface of the card main body 145 of the card 140 contacts the switch case 150 with pressure so as to close up the switch opening 151 of the switch case 150. With this, in the turn-off state of the switch portion 100, it is possible to prevent the dust or the like from intruding into the inside of the switch case 150 from the switch opening 151.

Under the turn-on state of the switch portion 100, in order to prevent the dust or the like from intruding into the area surrounded by the base block 130 and the switch case 150, a cover portion 152 provided in the vicinity of the switch opening 151 of the switch case 150 and a button end portion 162 in a U-like shape provided in the button 160 are provided. Under the turn-on state of the switch portion 100, the button end portion. 162 in the U-like shape of the button 160 covers the cover portion 152 of the switch case 150. Therefore, the switch opening 151 may be closed up by the cover portion 152 and the button end portion 162. With this, in the turn-on state of the switch portion 100, it is possible to prevent the dust or the like from intruding into the inside of the switch case 150 from the switch opening 151.

(ON and OFF Operations in Connector)

Next, the on and off operations in the connector of the first embodiment are described. While the connector of the first embodiment and the plug connector 200 are connected, by controlling turn on or off the connector of the first embodiment, the switch portion 100 can be turned on or off to enable to control the electric power supply from the electric power source or the like.

Figure 13:
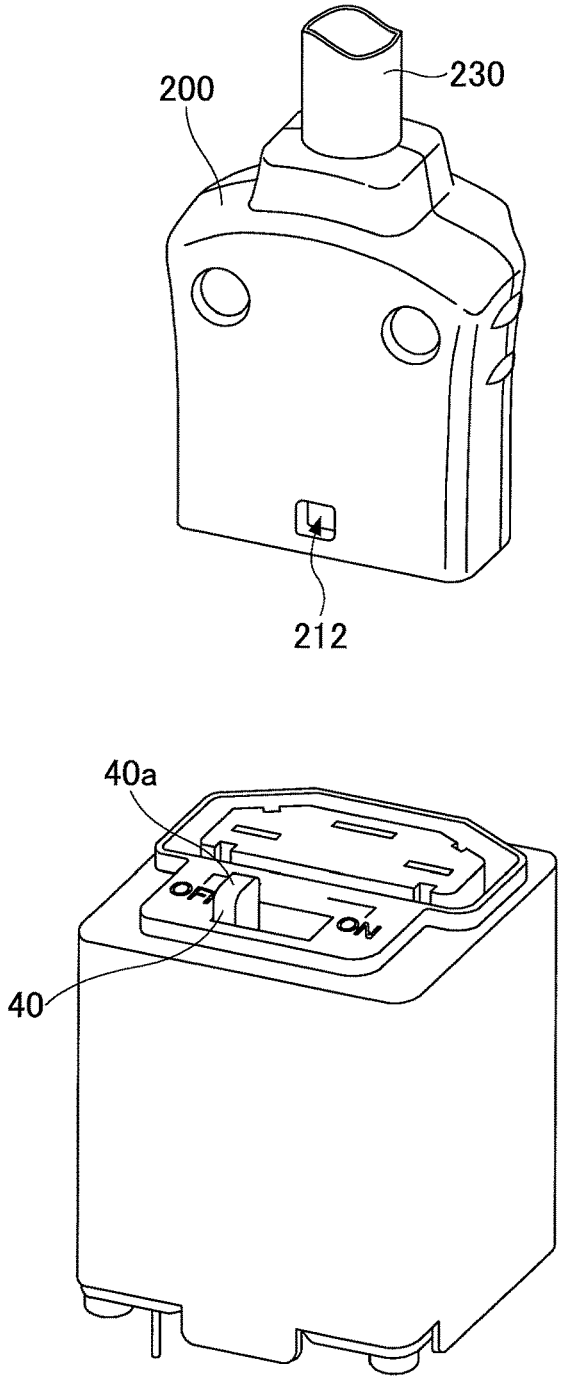
FIG. 13 is an explanatory view explaining a state before connecting the connector to the plug connector of the first embodiment.
Figure 14:
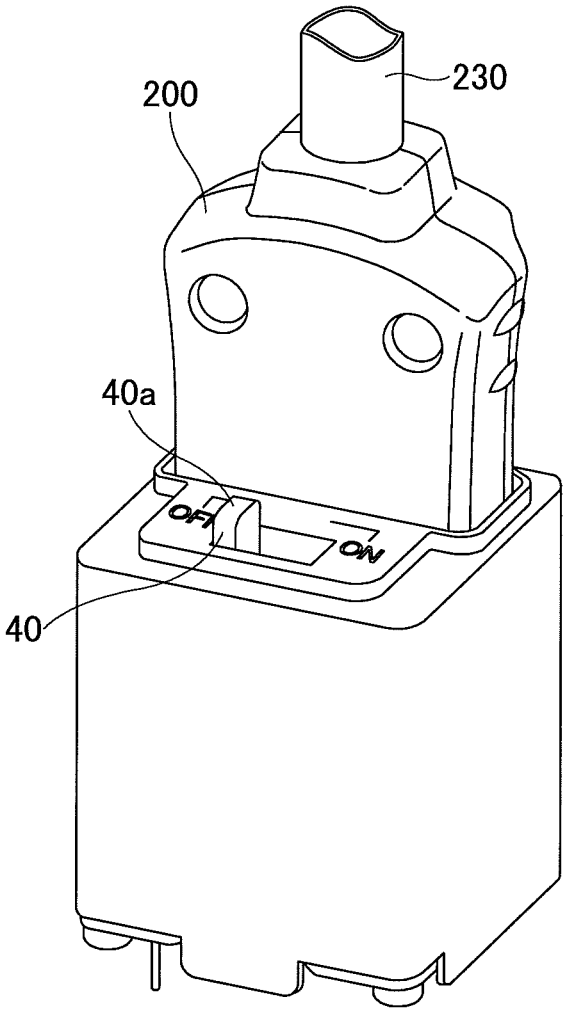
FIG. 14 is an explanatory view explaining a turn-off state after connecting the connector to the plug connector of the first embodiment.

At first, the connector and the plug connector 200 are connected as illustrated in FIG. 14 from the state where the connector of the first embodiment is not connected to the plug connector 200 as illustrated in FIG. 13. Under the state illustrated in FIG. 14, the upper slide operating portion 40*a* of the slide operating portion 40 of the connector of the first embodiment is in a position of "OFF", and the connector is in the turn-off state. Therefore, the connector and the plug connector are not electrically connected and electric power or the like is not supplied via the connector.

Figure 15:
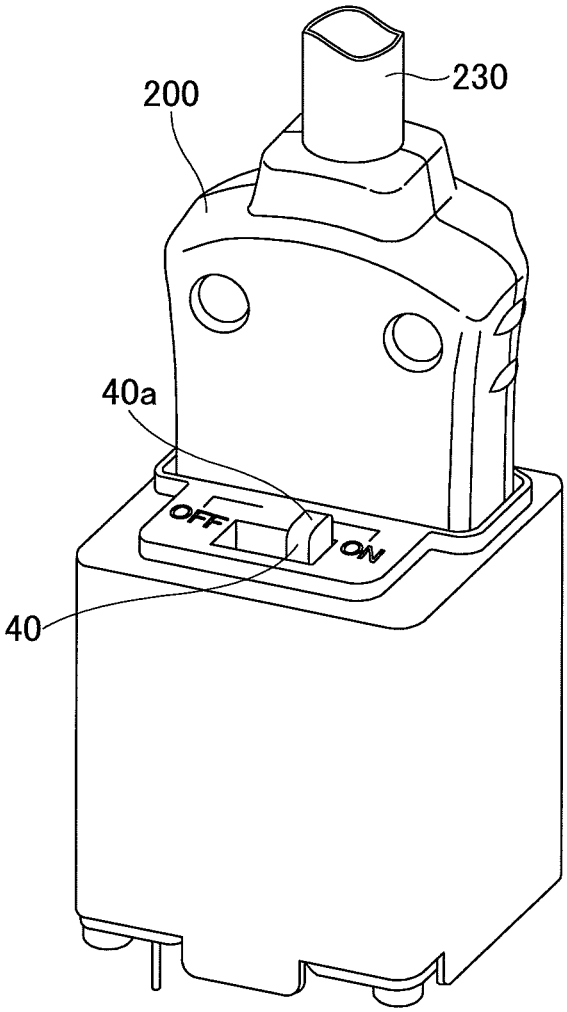
FIG. 15 is an explanatory view explaining a turn-on state after connecting the connector to the plug connector of the first embodiment.

Referring to FIG. 15, the upper slide operating portion 40*a* of the slide operating portion 40 of the connector of the first embodiment is slid to the position of "ON" to change the connector to be in the turn-on state. With this, the connector of the first embodiment and the plug connector 200 are electrically connected to enable supplying electric power via the connector. Hereinafter, a transition from the turn-off state illustrated in FIG. 14 to the turn-on state illustrated in FIG. 15 is described in detail.

Figure 16:
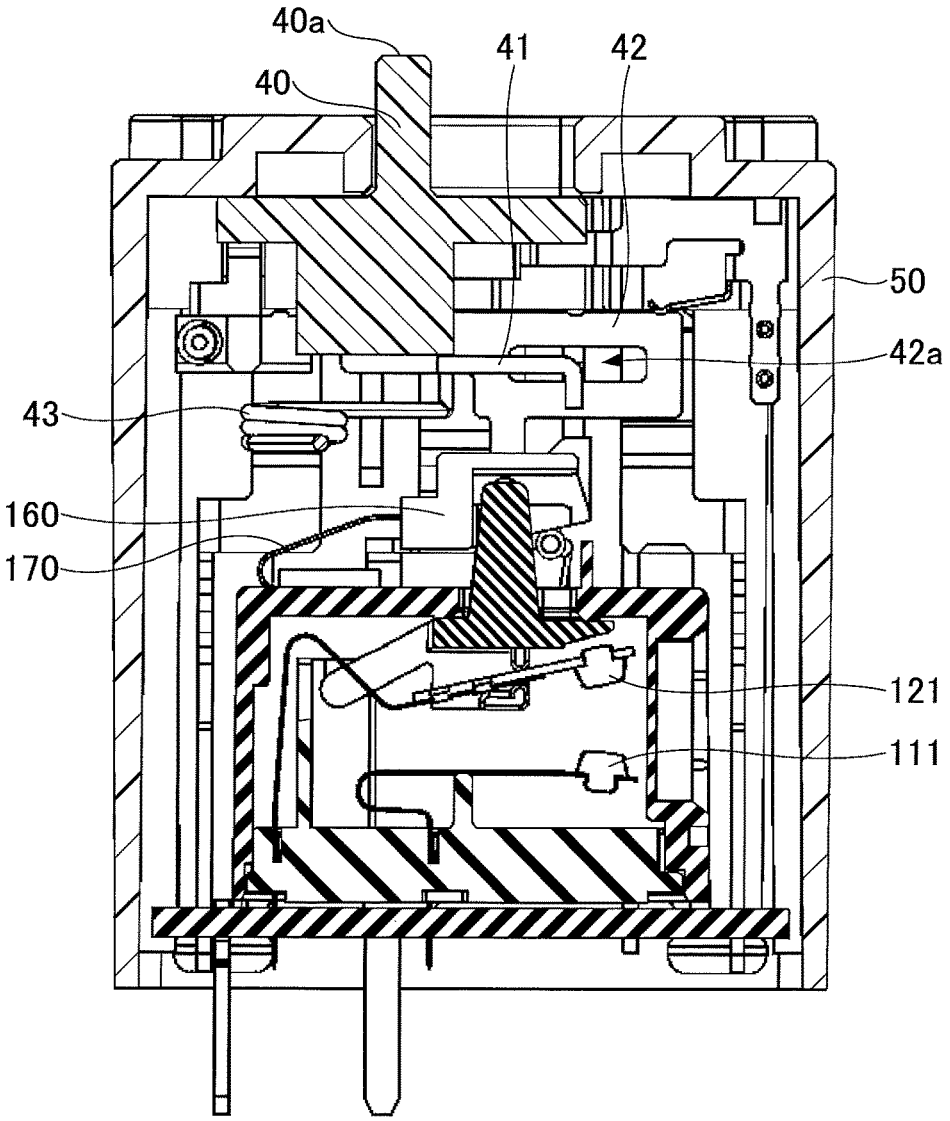
FIG. 16 is an internal structural view viewed from a side surface of the connector in the turn-off state of the first embodiment.
Figure 17:
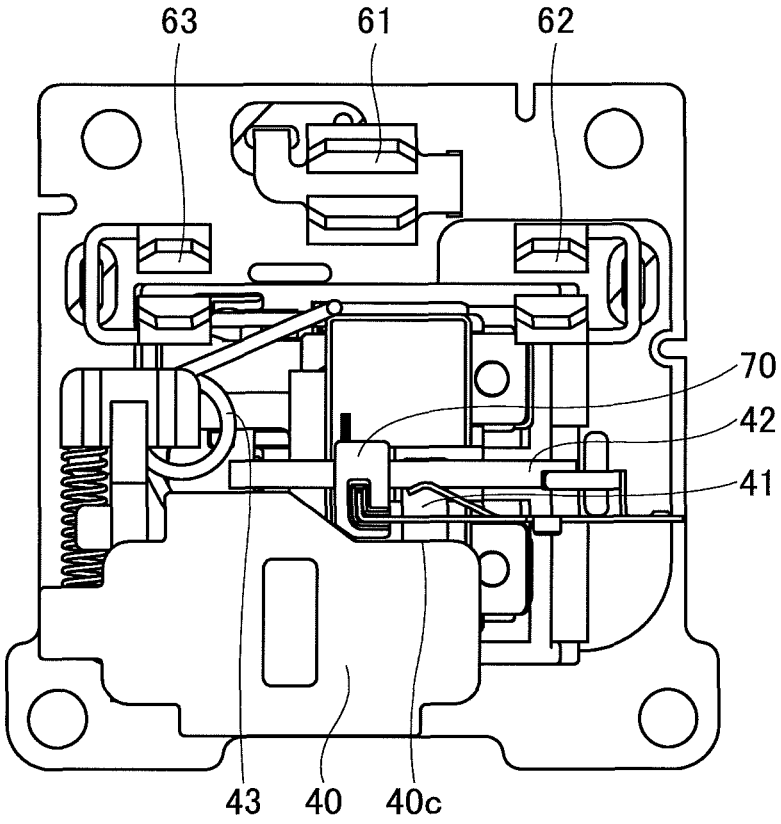
FIG. 17 is an internal structural view viewed on the upper surface of the connector in the turn-off state of the first embodiment.
Figure 18:
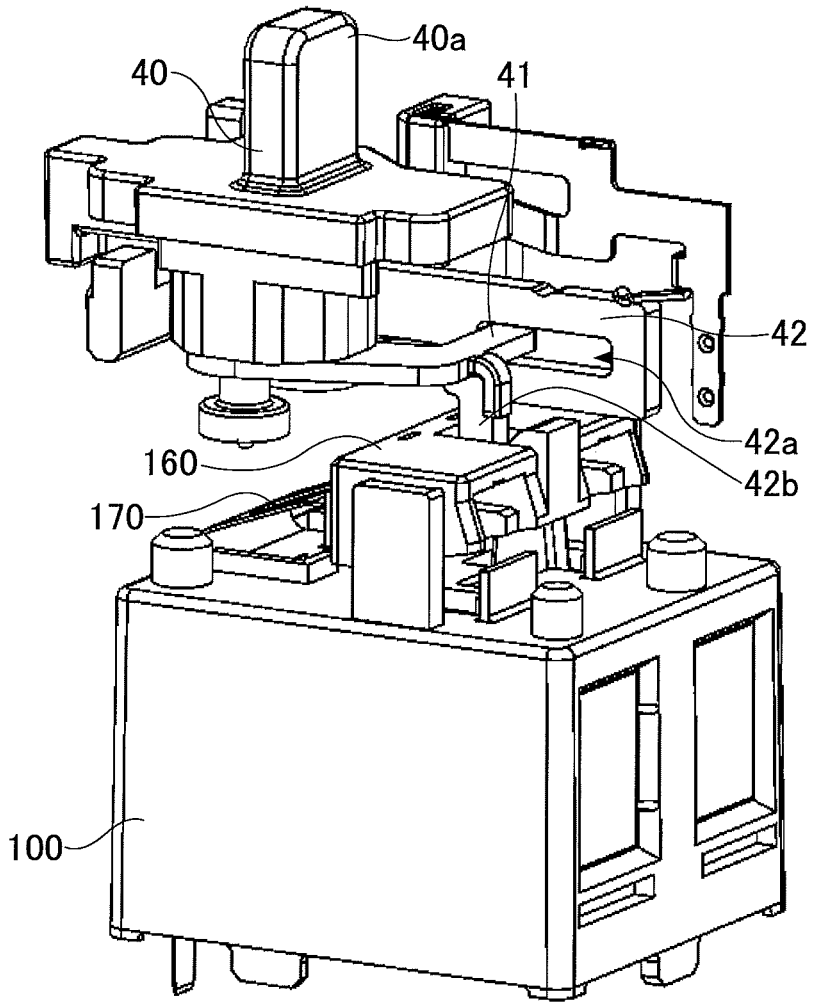
FIG. 18 is a perspective view of a portion of the connector in the turn-off state.
Figure 19:
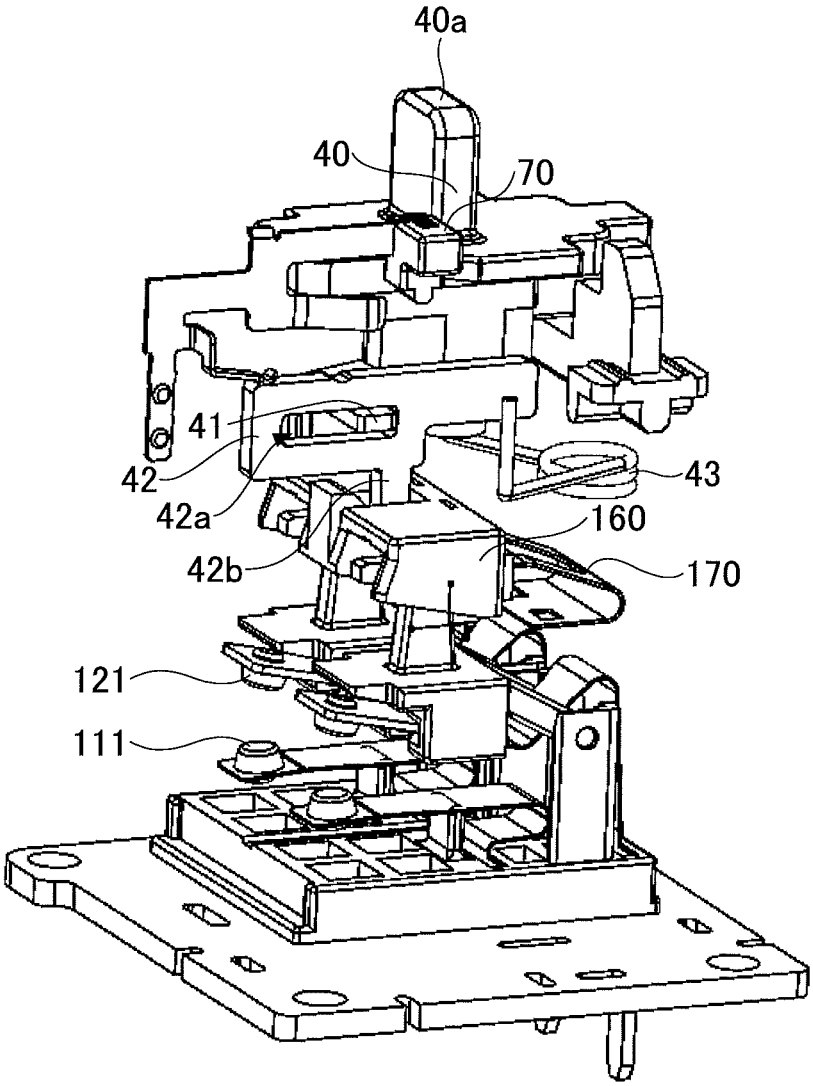
FIG. 19 is a perspective view of a mechanism of the connector in the turn-off state.
Figure 20:
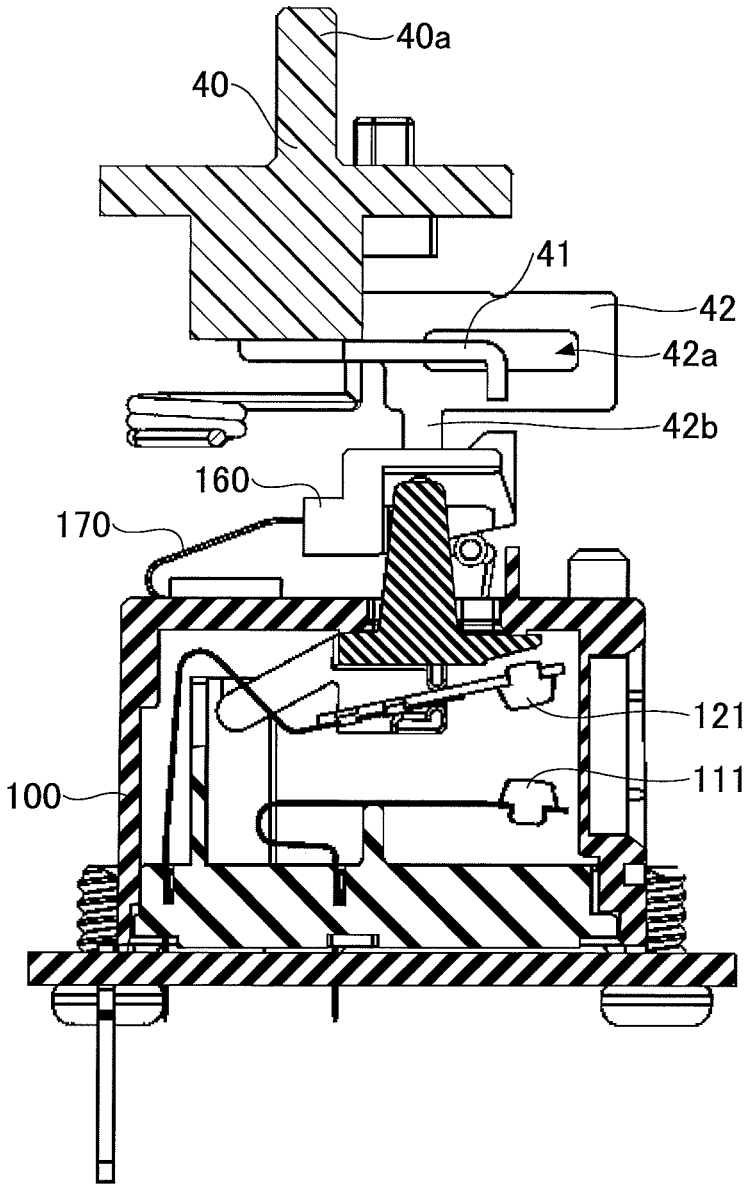
FIG. 20 is a perspective view of a portion of the connector in the turn-off state of the first embodiment.

Next, referring to FIGS. 16 to 20, the turn-off state illustrated in FIG. 14 is described. FIG. 16 is an internal structural view viewed from a side surface of the connector of the first embodiment in the turn-off state. FIG. 17 is an internal structural view viewed from the upper surface of the connector of the first embodiment. FIG. 18 is a perspective view of a part of the internal structure of the connector of the first embodiment. FIG. 19 is a perspective view of a portion of a mechanical portion. FIG. 20 is a side view of the internal structure. When the connector is in the turn-off state, because the upper slide operating portion 40*a* is at a position of "OFF", one end of the L-shaped slide linking portion 41 contacts the left side of the contact slide opening portion 42*a* of the contact slide portion 42. One end of the torsion spring 43 is connected to a part of the casing 50, and the other end of the torsion spring 43 is connected to the slide operating portion 40.

Figure 21:
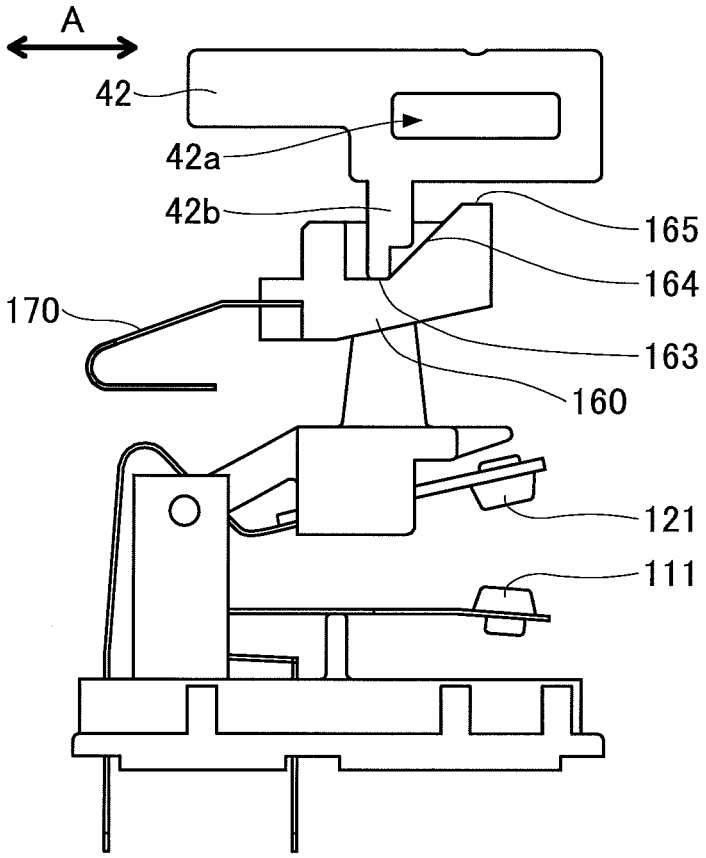
FIG. 21 is an explanatory view of the connector in the turn-off state of the first embodiment.

Referring to FIG. 21, the contact slide portion 42 includes a contact slide contacting portion 42*b* extending in a direction substantially perpendicular to sliding directions illustrated in arrows A. An end of the contact slide contacting portion 42*b* contacts a button bottom portion 163 of a groove formed on the upper surface of the button 160.

Jack terminals 61, 62, and 63 to be electrically connected to the plug terminals 221, 222, and 223 are provided inside the jack openings 21, 22, and 23 of the connector of the first embodiment. The switch portion 100 contains two pairs of the fixed portion 110 and the movable portion 120 corresponding to the jack terminals 62 and 63. Said differently, the jack terminal 62 is connected to any one of the fixed and movable portions 110 and 120 of any one pair of the pairs of the fixed portion 110 and the movable portion 120, and the other one of the fixed and movable portions 110 and 120 is connected to an electric power source (not illustrated). Further, the jack terminal 63 is connected to one of the fixed and movable portions 110 and 120 of the other pair of the pairs of the fixed portion 110 and the movable portion 120, and the other one of the fixed and movable portions 110 and 120 is connected to an electric power source (not illustrated). Further, a hook 70 illustrated in FIG. 22 contacts a narrow portion 40*c* in a side surface of the slide operating portion 40. Under this state, because the hook 70 is not inserted into the connector connection hole 212 of the plug connector 200, the connector of the first embodiment can be attached to or detached from the plug connector 200.

Figure 23:
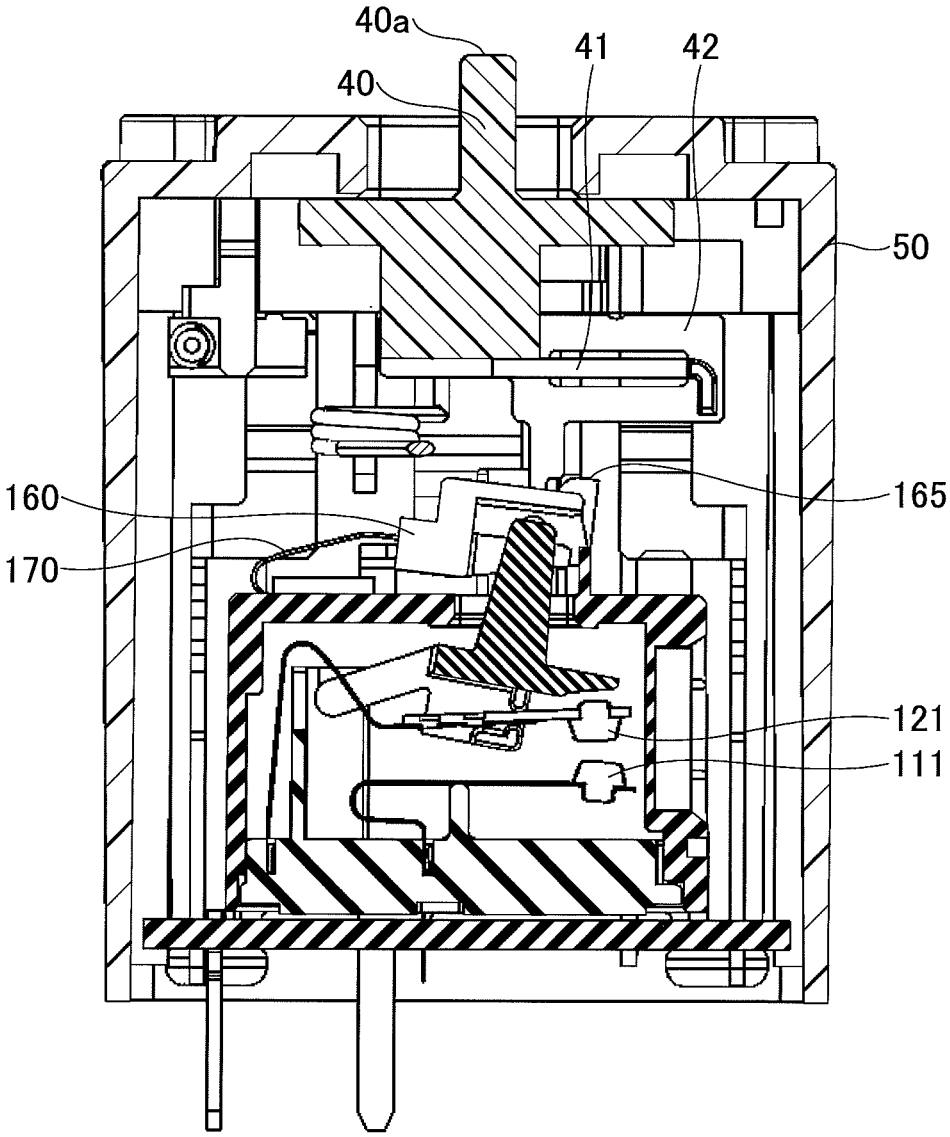
FIG. 23 is an internal structural view viewed on the side surface of the connector in a stage of changing from the turn-off state to the turn-on state of the first embodiment.
Figure 24:
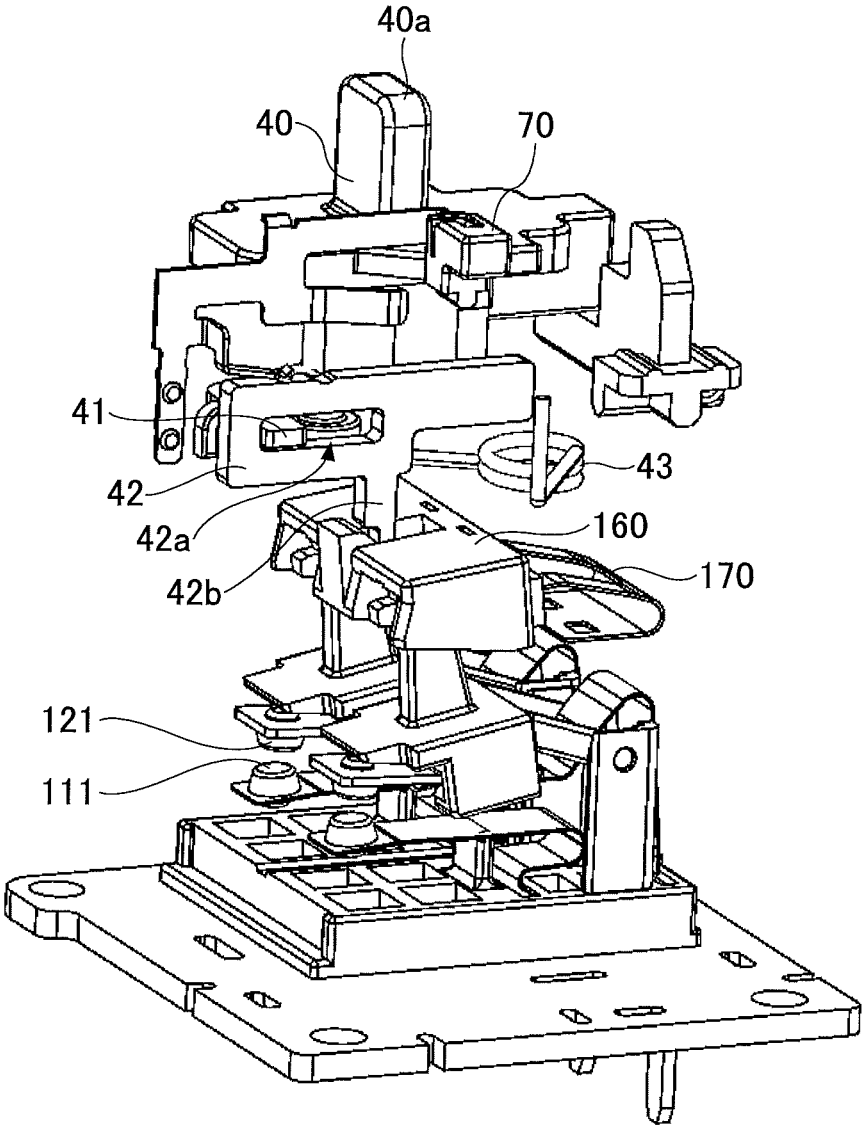
FIG. 24 is a perspective view of the connector in the stage of changing from the turn-off state to the turn-on state of the first embodiment.
Figure 25:
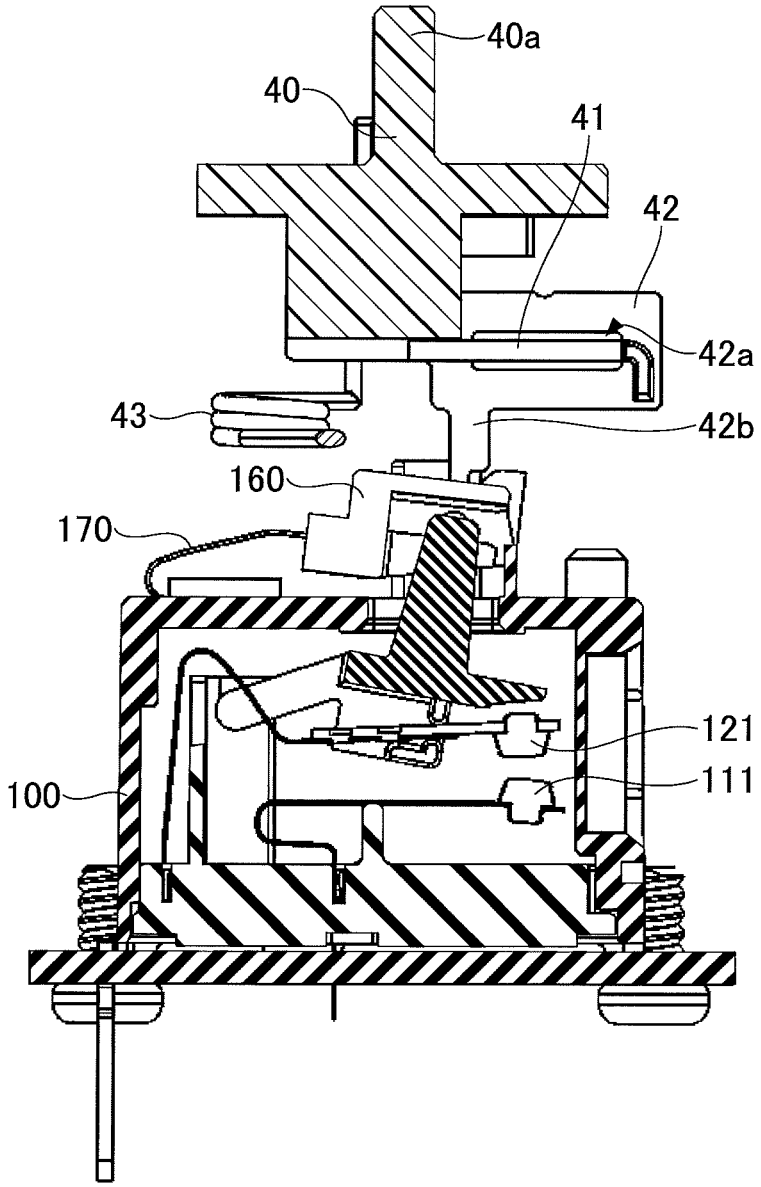
FIG. 25 is a side view of a portion of the connector in the stage of changing from the turn-off state to the turn-on state of the first embodiment.

Referring to FIGS. 23 to 25, an explanation is given on a case where the slide operating portion 40 is moved to a position substantially in a middle between the turn-off state and the turn-on state. FIG. 23 is an internal structural view viewed on the side surface side of the connector of the first embodiment under this state. FIG. 24 is a perspective view of a portion of a mechanical part. FIG. 25 is a side view of a portion of an internal structure. Under this state, the upper slide operating portion 40*a* is substantially at a middle position between the position of "ON" and the position of "OFF". One end of the L-shaped slide linking portion 41 contacts the right side of the contact slide opening portion 42*a* of the contact slide portion 42 to slightly move the contact slide portion 42 in the sliding direction. With this, the end of the contact slide contacting portion 42*b* contacts a button slant portion 164 of the groove formed in the button 160 illustrated in FIG. 21. Under this state, the fixed contact 111 of the fixed portion 110 does not contact the movable contact 121 of the movable portion 120.

Figure 26:
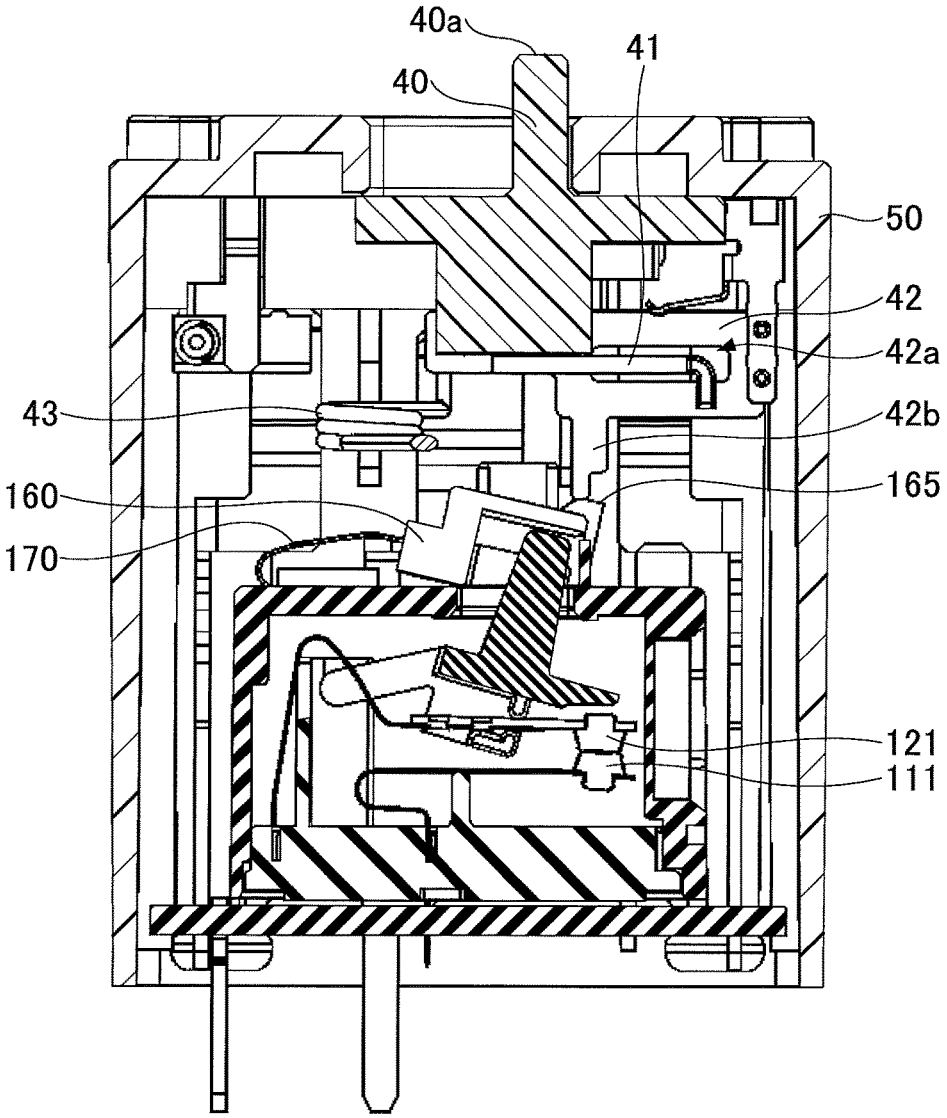
FIG. 26 is an internal structural view viewed on the side surface of the connector in the turn-on state of the first embodiment.
Figure 27:
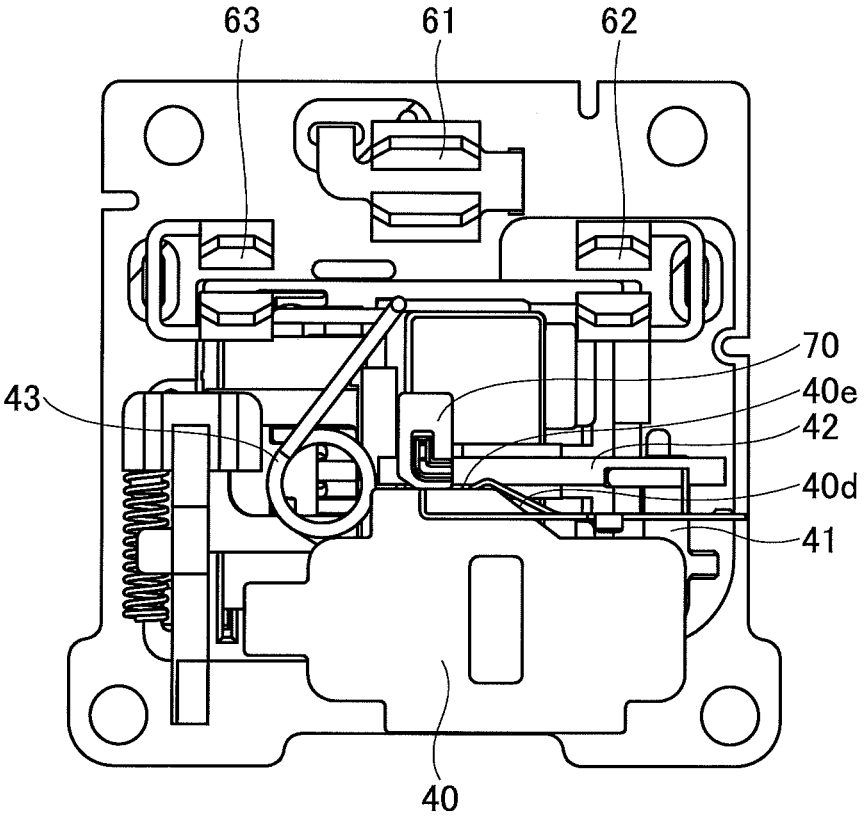
FIG. 27 is an internal structural view viewed on the upper surface of the connector in the turn-on state of the first embodiment.
Figure 28:
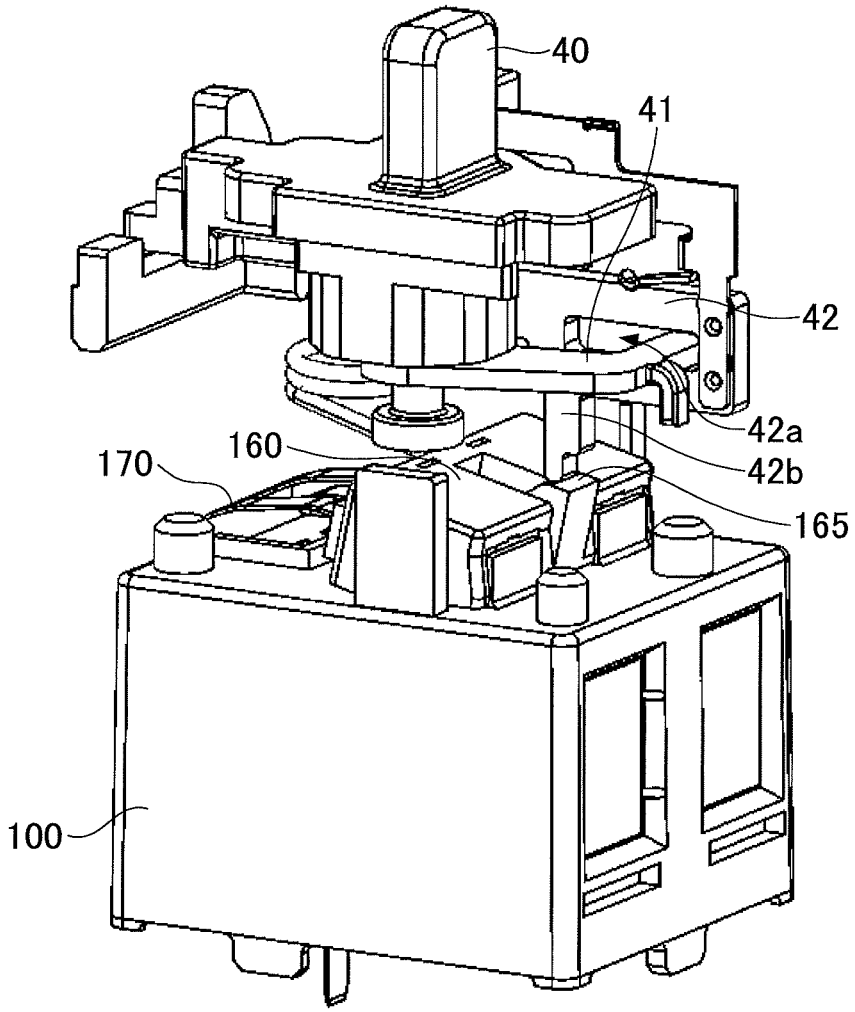
FIG. 28 is a perspective view of a portion of the connector in the turn-off state of the first embodiment.
Figure 29:
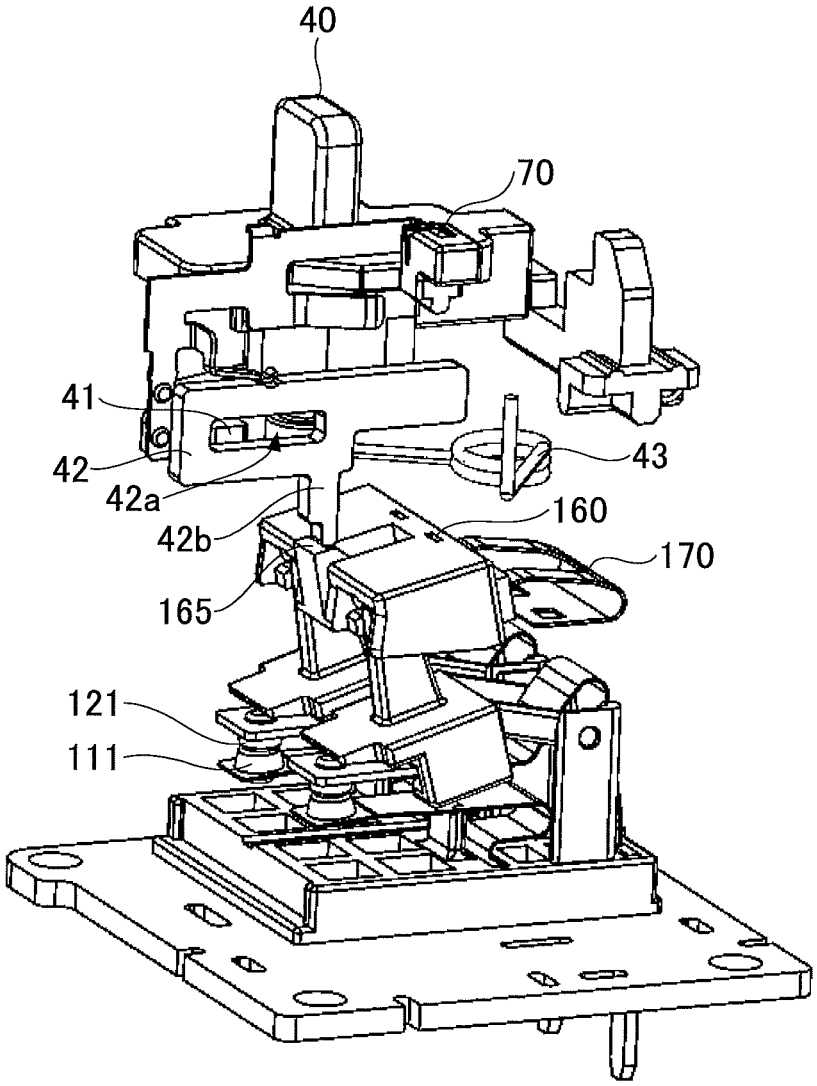
FIG. 29 is a perspective view of a mechanism of the connector in the turn-on state of the first embodiment.
Figure 30:
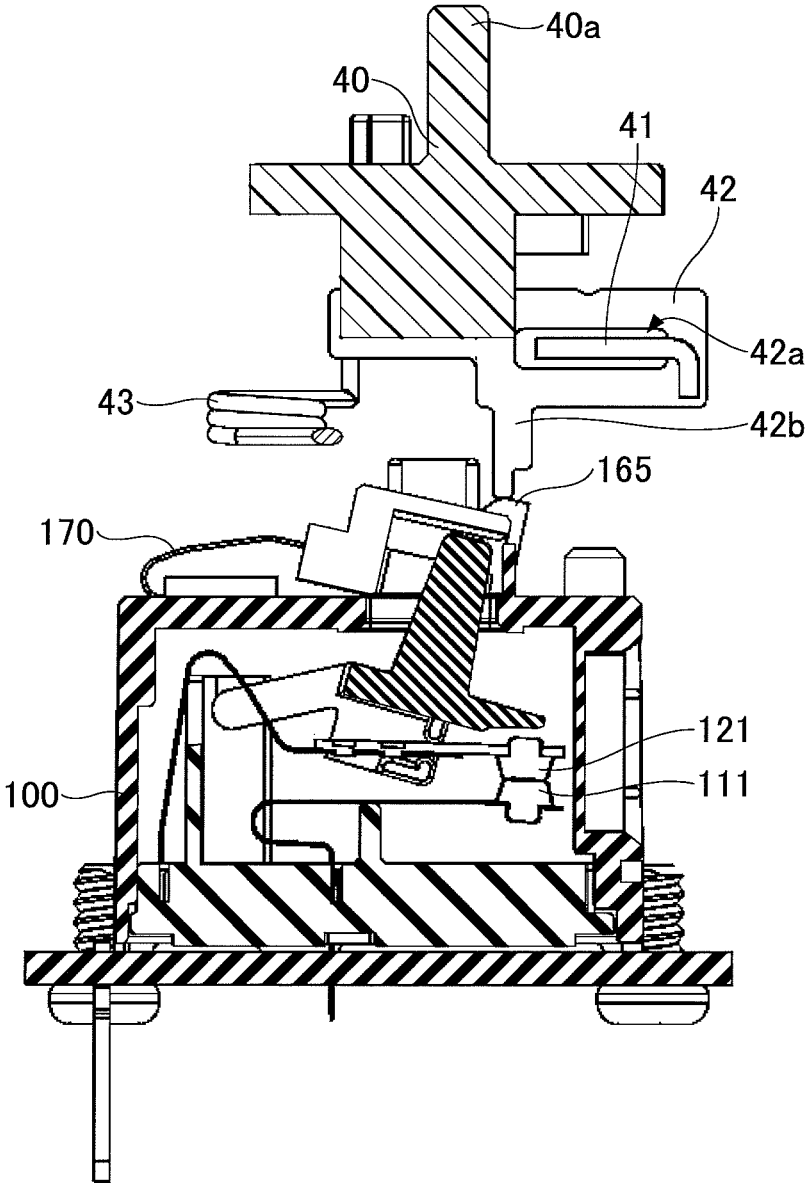
FIG. 30 is a perspective view of a portion of the connector in the turn-on state of the first embodiment.

Next, referring to FIGS. 26 to 30, the turn-on state illustrated in FIG. 15 is described. FIG. 26 is an internal structural view viewed from a side surface of the connector of the first embodiment in this turn-on state. FIG. 27 is an internal structural view viewed from the upper surface of the connector of the first embodiment. FIG. 28 is a perspective view of a part of the internal structure of the connector of the first embodiment. FIG. 29 is a perspective view of a portion of a mechanical portion. FIG. 30 is a side view of the internal structure. Under the turn-on state, the upper slide operating portion 40*a* is at a position of "ON". The right side of the contact slide opening portion 42*a* of the contact slide portion 42 is further pushed by the one end of the L-shaped slide linking portion. Thus, the contact slide portion 42 is further moved in this direction. With this, the end of the contact slide contacting portion 42*b* of the contact slide portion 42 contacts a button upper stage portion 165 provided in the button 160. Under this state, because the button 160 of the switch portion 100 is pushed by the contact slide contacting portion 42*b*, the fixed contact 111 of the fixed portion 110 contacts the movable contact 121 of the movable portion 120. This turn-on state is maintained by the contact between the button upper portion 165 of the button 160 and the end of the contact slide contacting portion 42*b* of the contact slide portion 42.

Figure 22:
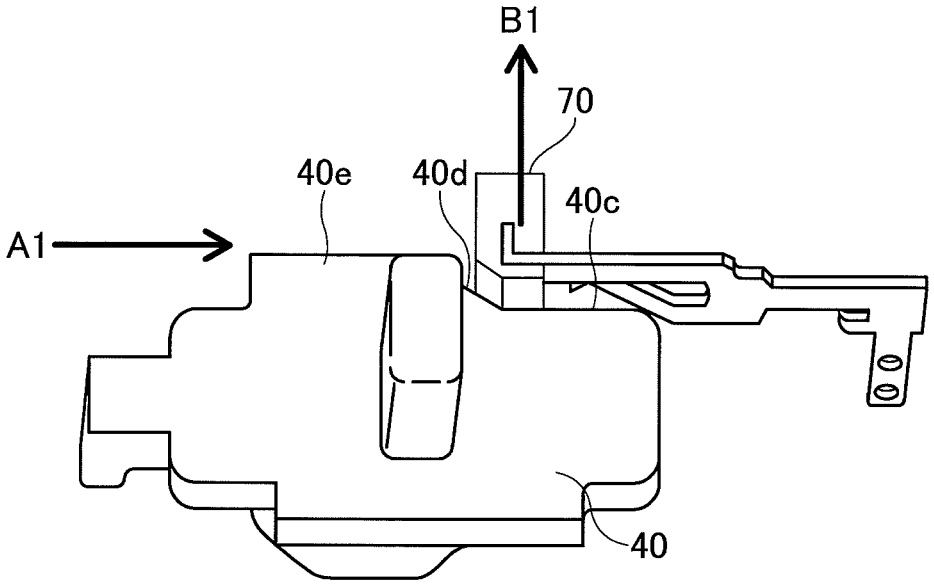
FIG. 22 is an explanatory view of a hook of the connector of the first embodiment.

Further, when the turn-off state changes to the turn-on state, the position of the side surface of the slide operating portion 40, in which the hook 70 illustrated in FIG. 22 contacts, changes from the narrow portion 40*c* on the side surface of the slide operating portion 40 to a wide portion 40*e* via a slant portion 40*d*. By sliding the upper slide operating portion 40*a* in the sliding direction A1, the hook 70 is moved in a direction along an arrow B1, which is substantially perpendicular to the sliding direction. Because the moved hook 70 is inserted into the connector connection hole 212 provided in the plug connector 200 so as to be engaged with the connector connection hole 212, a connection between the connector of the first embodiment and the plug connector is maintained.

When the turn-on state is changed to the turn-off state, the position of the upper slide operating portion 40*a* of the connector of the first embodiment is slid from the position "ON" to the position "OFF". By sliding the position of the upper slide operating portion 40*a* as described above, the position where the end of the contact slide contacting portion 42*b* of the contact slide portion 42 contacts is moved from the button upper stage portion 165 of the button 160 to the button bottom portion 163 via the button slant portion 164. With this, the button 160 is lift up by the swing spring 170 to release the contacts between the fixed contact 111 and the movable contact 121 of each pair of the fixed portion 110 and the movable portion 120. Thus, the switch portion becomes the turn-off state. At this time, the position of the side surface of the slide operating portion 40 that the hook 70 contacts is moved from the wide portion 40*e* on the side surface of the slide operating portion 40 to the narrow portion 40*c* via the slant portion 40*d*. With this, the hook 70 moves outward from the inside of the connector connection hole 212 of the plug connector 200 to thereby enable the plug connector 200 being disconnected from the connector of the first embodiment.

Second Embodiment

Next, a switch of a second embodiment is described. The switch of the second embodiment corresponds to the switch portion of the first embodiment. The switch is described in more detail.

A power source switch used in a case where the voltage supplied from an electric power source is 100 V or greater.

When the voltage supplied from the electric power source is 100 V or greater, e.g., direct current 400 V, a commercially available switch may not shut down electric power supply. This phenomenon may be caused when contacting contacts are molten by heat caused by any reason because the voltage is high or the direct current is used. If such a phenomenon is caused, the function as the switch is completely lost to influence the electric power supply. Therefore, there occurs a problem in the function of the switch.

(Switch)

Figure 31:
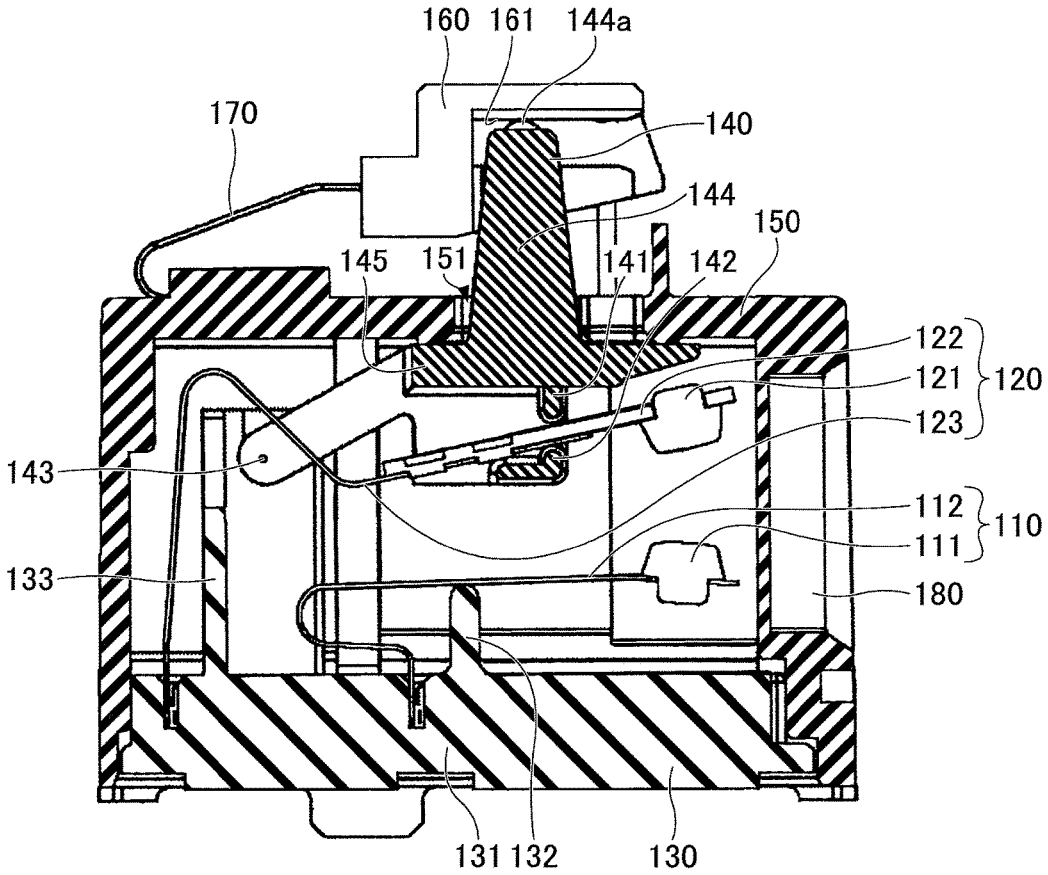
FIG. 31 is a structural view of a switch in a turn-off state of a second embodiment.

Next, an example of the switch of the second embodiment is described. The switch of the second embodiment is used to control supply of electric power. The switch is referred to as a power source switch. Referring to FIG. 31, the switch can control ON or OFF of the power supply from the electric power source depending on whether the fixed contact 111 of the fixed portion 110 contacts the movable contact 121 of the movable portion 120.

The fixed portion 110 is entirely made of conductive material such as a metal. The fixed contact 111 capable of contacting the movable contact 121 of the movable portion 120 is provided in an end portion of the fixed spring 112. The fixed spring 112 is formed by bending a metallic plate made of copper, an alloy containing copper, or the like. The fixed contact 111 is made of an alloy containing silver and copper. The other end portion of the fixed spring 112 is fixed to the main base block 131 in the base block 130, and is supported by the fixing portion supporter 132 in a middle of the fixed spring 112.

The movable portion 120 is entirely formed by conductive material such as a metal. The movable contact 121 capable of contacting the fixed contact 111 of the fixed portion 110 is provided in the one end portion of the movable plate 122, and the other end portion of the movable plate 122 is connected to the one end portion of the movable spring 123. The movable plate 122 and the movable spring 123 are made of a metallic plate made of copper, an alloy containing copper, or the like. The movable contact 121 is made of an alloy containing silver and copper. The other end portion of the movable spring 123 is fixed to the main base block 131 of the base block 130. However, because the movable spring 123 is formed by bending a metallic plate or the like, the movable spring 123 has flexibility. Therefore, the movable contact 121 provided in the one end portion of the movable plate 122 can be moved up and down. Further, in the base block 130, the insulating wall 133 made of flame resistant resin material or the like is provided between a portion where the other end portion of the fixed spring 112 is connected and a portion where the other end portion of the movable spring 123 is connected. The movable spring 123 is bent so as to surround a part of the periphery of the insulating wall 133 from the other end portion.

The upper surface, which is one surface, of the movable plate 122 of the movable portion 120, contacts an upper contact part 141, which is a first contact portion, of the card 140. The lower surface, which is another surface, of the movable plate 122 of the movable portion 120 contacts the lower contact part 142, which is a second contact portion, of the card 140. Under the state, by rotating the card 140 around the rotating shaft 143, force is applied by the contact of the movable plate 122 with the upper contact part 141 or the lower contact part 142 thereby upwardly or downwardly moving the movable contact 121. Because the upper contact part 141 and the lower contact part 142 slide on the movable plate 122, the surface layer made of a fluorine resin may be formed on the surfaces of the upper contact part 141 and the lower contact part 142 in order to reduce the friction resistance.

The fixed portion 110 and the movable portion 120 are installed inside the area surrounded by the base block 130 and the switch case 150. The card 140 includes the protruding portion 144 outwardly protruding from the switch opening 151, which is provided in the switch case 150, and the card main body 145 positioned inside the area surrounded by the base block 130 and the switch case 150. Therefore, in the switch, the upper contact part 141 or the lower contact part 142 is provided inside the area surrounded by the base block 130 and the switch case 150. Further, the card 140, the base block 130, and the switch case 150 are formed by insulating material made of resin material or the like.

Outside the switch case 150, the button 160 is provided to rotate the card 140 around the rotating shaft 143. The card 140 contacts the button inner portion 161 of the button 160 at the contact portion 144*a* provided at the upper portion of the protruding portion 144 of the card 140. Because the contact portion 144*a* slides on the surface of the button inner portion 161, the surface layer made of a fluorine resin or the like may be formed on the surface of the button inner portion 161 in order to reduce the friction resistance. Outside the switch case 150, the swing spring 170 is provided. One end of the swing spring 170 is connected to the switch case 150 and the other end of the swing spring 170 is connected to the button 160.

(ON and OFF Operations)

Figure 32:
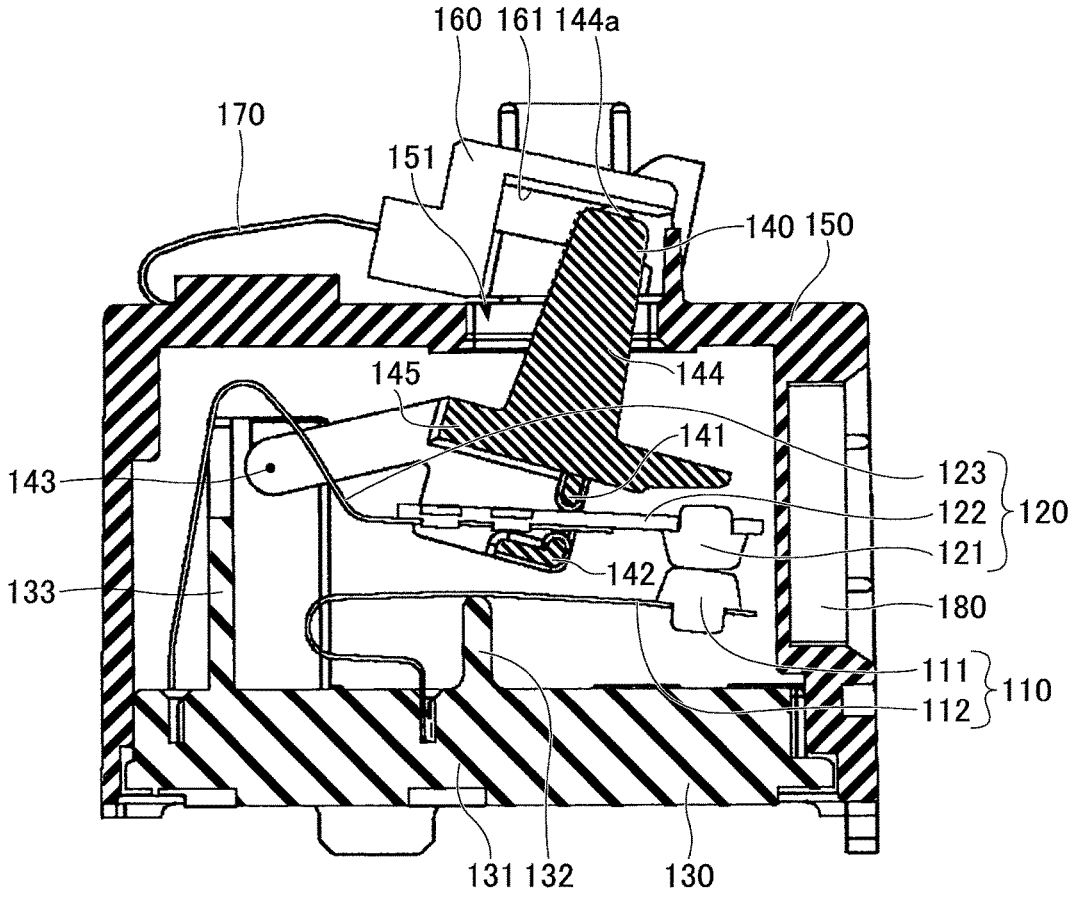
FIG. 32 is a structural view of the switch in the turn-on state of the second embodiment.

In the switch of the second embodiment, if the switch is turned on, the button 160 is pushed. Then, the card 140 contacting the button inner portion 161 of the button 160 at the contacting portion 144*a* rotates around the rotating shaft 143. Therefore, force is applied downwardly to the movable plate 122 of the movable portion 120 by the upper contact part 141 to thereby make the movable contact come into contact with the fixed contact. This state is illustrated in FIG. 32. In the switch of the second embodiment, a turn-on state retaining mechanism or the like (not illustrated) having a locking portion or the like for maintaining the contact between the movable contact and the fixed contact is provided. By the turn-on state retaining mechanism or the like, the contact between the movable contact 121 and the fixed contact is maintained to continue the electric power supply from the electric power source.

Further, in the switch of the second embodiment, if the switch is turned off, the locking portion of the turn-on state retaining mechanism (not illustrated) or the like is released thereby turning off the switch by the restoring force caused by the spring property of the swing spring 170. Said differently, as illustrated in FIG. 31, the card 140 in contact with the button inner portion 161 of the button 160 at the contact portion 144*a* is rotated around the rotating shaft 143. Force is upwardly applied to the movable plate 122 of the movable portion 120 via the lower contacting part 142. As described, it becomes possible to cancel the contact between the movable contact 121 and the fixed contact 111 by the upward force applied to the movable plate 122 thereby stopping the electric power supply from the electric power source. At this time, arc may be generated between the movable contact 121 and the fixed contact 111. In order to disperse the arc by force of a magnetic field, a permanent magnet 180 for generating a magnetic field in a direction substantially perpendicular to the direction of generating the arc is provided in the vicinity of the position where the movable contact 121 contacts the fixed contact 111.

In the switch, when the electric power supply from the electric power source is shut down, instead of using the restoring force of the movable spring 123 of the movable portion 120 or the like, the restoring force of the swing spring 170 provided outside the switch case 150 is used to change into the turn-off state. Therefore, in a case where the restoring force is not accumulated by the movable spring 123 of the movable portion 120 or the like, the electric power source can be turned off. Further, if a part of the movable spring 123 or the like is molten by heat and the function as the spring is lost in the movable spring 123, without using the restoring force of the movable spring 123 or the like, the electric power source is made the turned-off state by spring property of the swing spring 170. Thus, the electric power supply from the electric power source can be securely shut down. Further, because the swing spring 170 is installed outside the switch case 150, the swing spring 170 is not influenced by heat or the like unlike the fixed portion 110 and the movable portion 120, which are influenced by heat or the like inside the switch case 150.

Further, in the base block 130 of the switch portion 100, the insulating wall 133 is provided between the portion, to which the other end portion of the fixed spring 112 is connected and the portion, to which the other end portion of the movable spring 123 is connected. With this, if the fixed portion 110 and the movable portion 120 are progressively molten by heat, the molten part of the fixed portion 110 and the molten part of the movable portion 120 are separated by the insulating wall 133. Therefore, it is possible to prevent an electric current from continuously flowing through the fixed portion 110 and the movable portion 120 while the fixed portion 110 and the movable portion 120 are molten and adhered.

(Explanation on Assembling Method of Switch)

Next, a point in the assembling method of the switch in the second embodiment is described.

Figure 33:
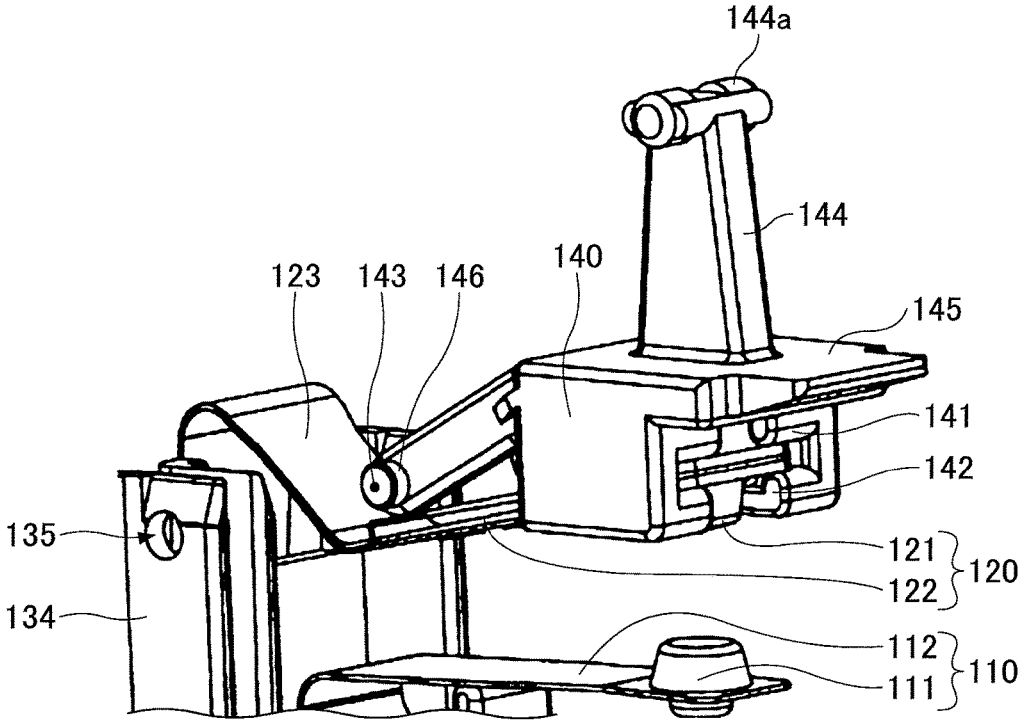
FIG. 33 is an explanatory view (1) of the switch of the second embodiment.

At first, in the switch of the second embodiment, an assembling method of connecting the base block 130 to the card 140 is described by referring to FIG. 33. The card 140 includes a rotating portion 146 in a circular shape, whose center matches the rotating shaft 143. The base block includes a card supporting portion 134 for connecting the card 140. The card supporting portion 134 has an opening portion 135 in a circular shape so that the rotating portion 146 of the card 140 is inserted. By inserting the rotating portion 146 into the opening portion 135, the card 140 is connected to the card supporting portion 134 so that the card 140 is rotatable around the rotating shaft 143. Further, the card 140 is provided along the movable plate 122 while the upper contact part 141 contacts the upper side of the movable plate 122 and the lower contact part 142 contacts the lower side of the movable plate 122. The card 140 is moved until the rotating portion 146 is inserted inside the opening portion 135 and then is assembled. Thus, the movable portion 120, the base block 130, and the card 140 are connected.

Figure 34:
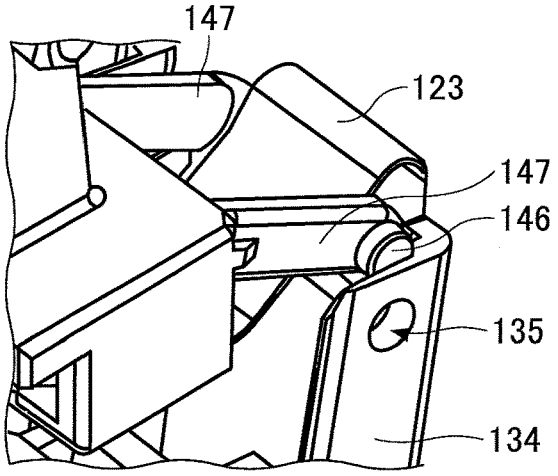
FIG. 34 is an explanatory view (2) of the switch of the second embodiment.
Figure 35:
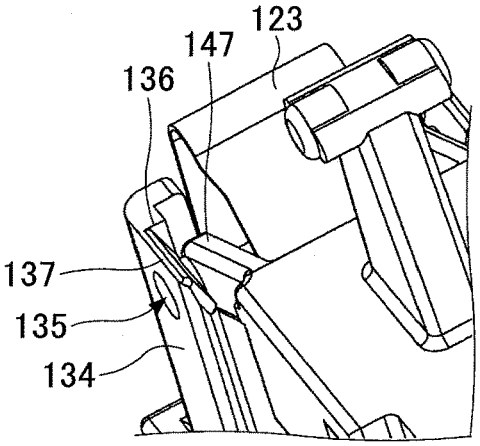
FIG. 35 is an explanatory view (3) of the switch of the second embodiment.

More specifically, the connection between the base block 130 and the card 140 is described based on FIGS. 34 and 35.

The rotating portions 146 of the card 140 are provided in end portions of each of two rods 147 so that the rotating portions 146 outwardly face. When the base block 130 and the card 140 are connected, the two rods 147 is bent inwardly to insert the rotating portions 146 into the opening portions 135 of the base block 130. Parts of the opening portions 135 and parts of the rotating portions 146, which mutually contact, are processed with mirror-like finishing so that a friction resistance is reduced.

Further, in order to insert the rotating portions 146 of the card 140 smoothly inside the opening portions 135 of the base block 130, the card supporting portion 134 includes guides 136 formed along a direction of inserting the rotating portions 146. Further, slant portions 137 are formed in the end portions of the card supporting portions 134 from which the rotating portions 146 are inserted therebetween.

Figure 36:
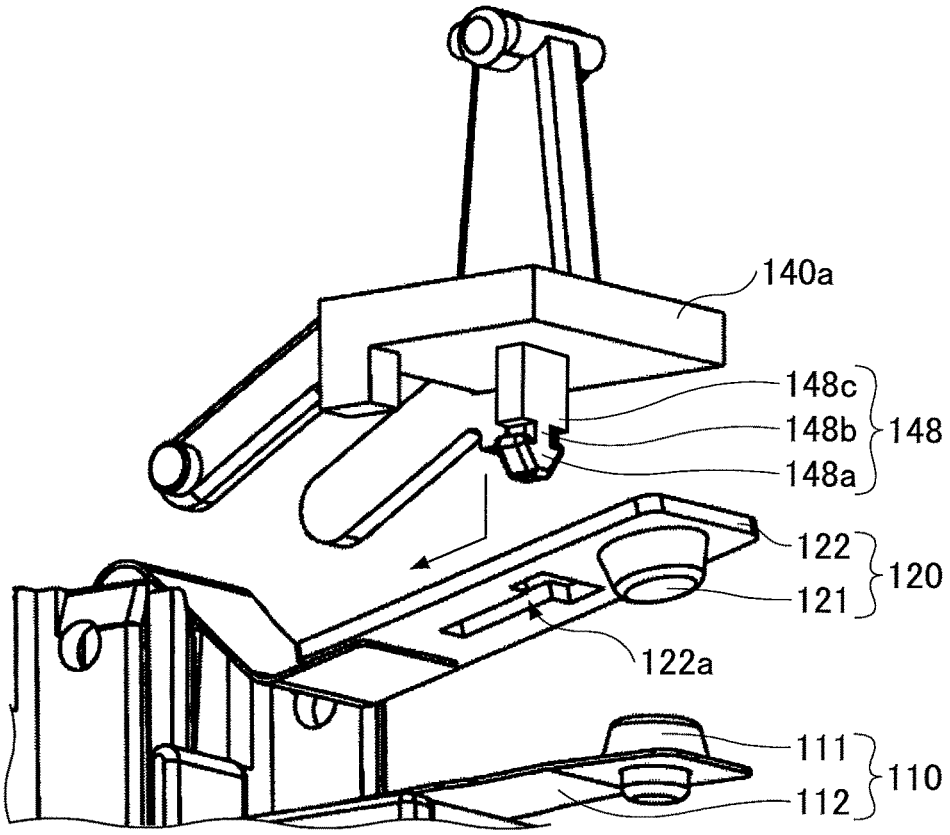
FIG. 36 is an explanatory view of another switch of the second embodiment.
Figure 37:
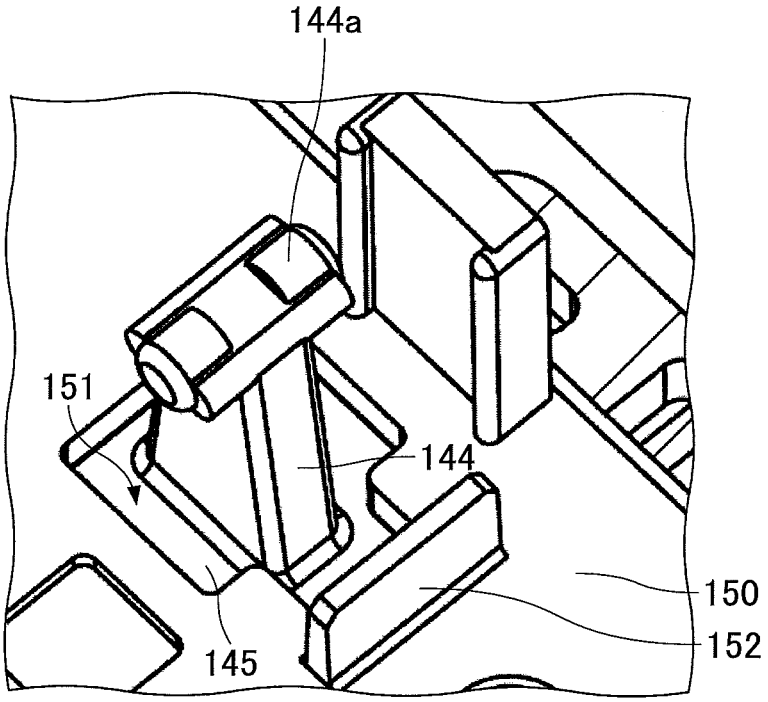
FIG. 37 is an enlarged view (1) of a portion of the switch of the second embodiment.
Figure 38:
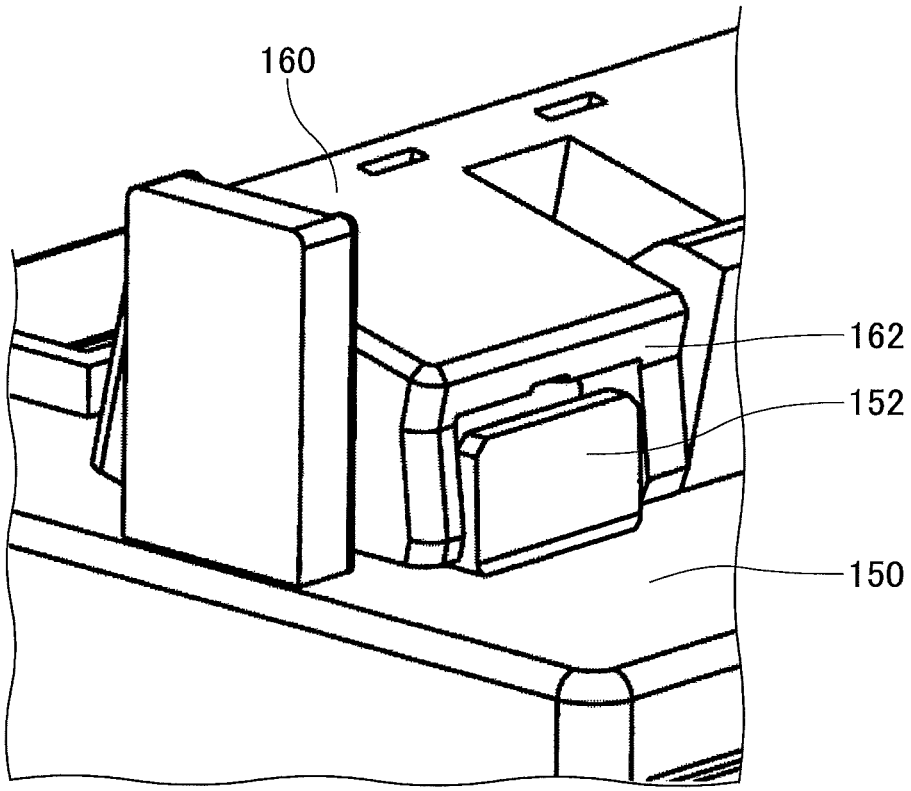
FIG. 38 is an enlarged view (2) of the portion of the switch of the second embodiment.

As described, in the card 140, the movable plate 122 is interposed between the upper contact part 141 and the lower contact part 142. However, as illustrated in FIG. 36, a T-shaped opening 122*a* may be formed in the movable plate 122, and a protruding connecting portion 148 may be formed instead of the upper contact part 141 and the lower contact part 142. The protruding connecting portion 148 includes an end portion 148*a* gradually sharpened to a tip, a narrow portion 148*b* adjacent to the end portion 148*a* and having a smaller width, and a body portion 148*c* adjacent to the narrow portion 148*b* and having a greater width. When the movable plate 122 is fixed to the card 140*a*, the end portion 148*a* and the narrow portion 148*b* of the protruding connecting portion 148 are inserted into the opening 122*a* formed in the movable plate 122. Under the state, the lower surface of the movable plate 122 is fixed between the narrow portion 148*b* and the end portion 148*a* wider than the narrow portion 148*b*. The upper surface of the movable plate 122 is fixed between the narrow portion 148*b* and the body portion 148*c* wider than the narrow portion 148*b*.

In the switch of the second embodiment, in a case where a dust or the like intrudes into an area surrounded by the base block 130 and the switch case 150, a short circuit or a contact failure may be caused between the fixed contact 111 and the movable contact 121. Therefore, in the turn-off state of the switch of the second embodiment, referring to FIG. 37, the upper surface of the card main body 145 of the card 140 contacts with pressure on an inner surface of the switch case 150 where the switch opening 151 is formed in order to prevent a dust or the like from intruding into the area surrounded by the base block 130 and the case 150. With this, in the turn-off state of the switch, it is possible to prevent the dust or the like from intruding into the inside of the switch case 150 from the switch opening 151.

Under the turn-on state of the switch, in order to prevent the dust or the like from intruding into the area surrounded by the base block 130 and the switch case 150, a cover portion 152 provided in the vicinity of the switch opening 151 of the switch case 150 and the button end portion 162 in the U-like shape provided in the button 160 are provided. Under the turn-on state of the switch, the button end portion 162 in the U-like shape of the button 160 covers the cover portion 152 of the switch case 150. Therefore, the switch opening 151 may be closed up by the cover portion 152 and the button end portion 162. With this, in the turn-on state of the switch, it is possible to prevent the dust or the like from intruding into the inside of the switch case 150 from the switch opening 151.

Figure 39:
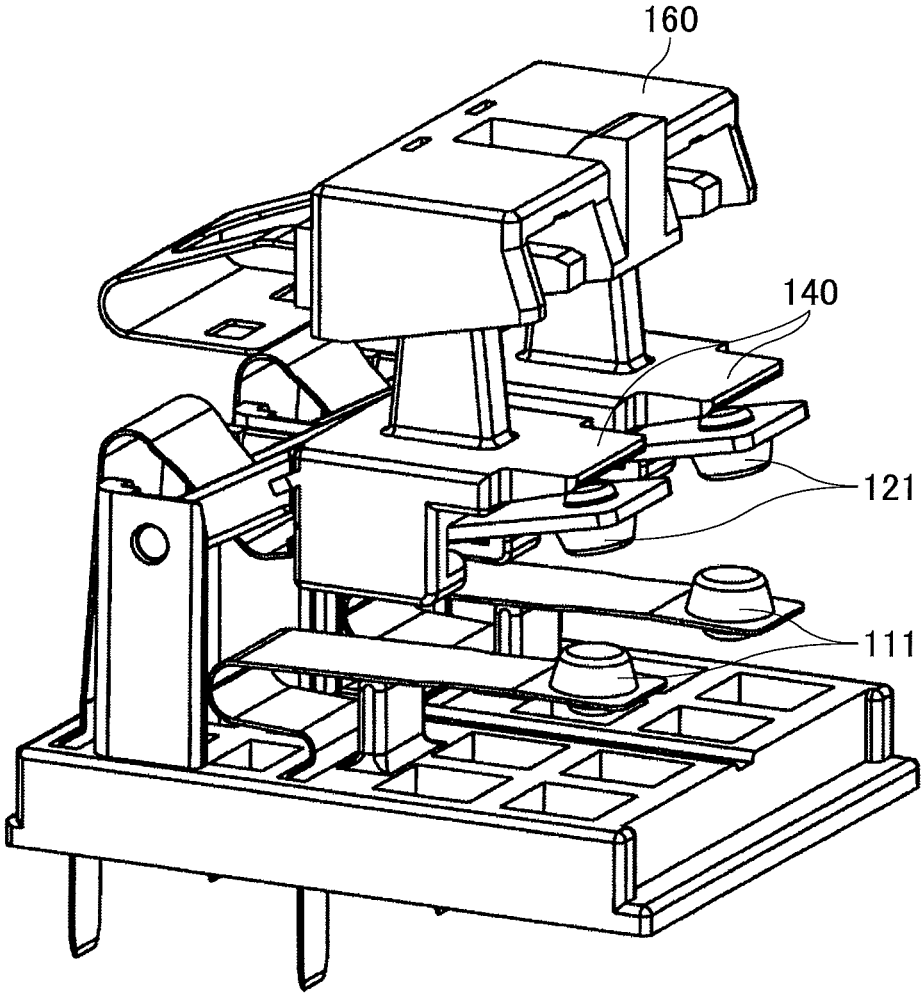
FIG. 39 is a structural view of another switch of the second embodiment.

Further, as illustrated in FIG. 39, within the second embodiment, the number of the fixed contacts 111 and the number of the movable contacts may be plural. In this case, by operating the single button 168, power supply to a plurality of electronic apparatuses or a plurality of electric circuits may be simultaneously changed to the turn-on state or the turn-off state. With this, it is possible to cause the plurality of fixed contacts 111 and the plurality of movable contacts 121 to be simultaneously the turn-on state or the turn-off state.

Third Embodiment

Next, a switch of a third embodiment is described. In the switch of the third embodiment, the turn-off state is illustrated in FIG. 40 and the turn-on state is illustrated in FIG. 41.

Figure 40:
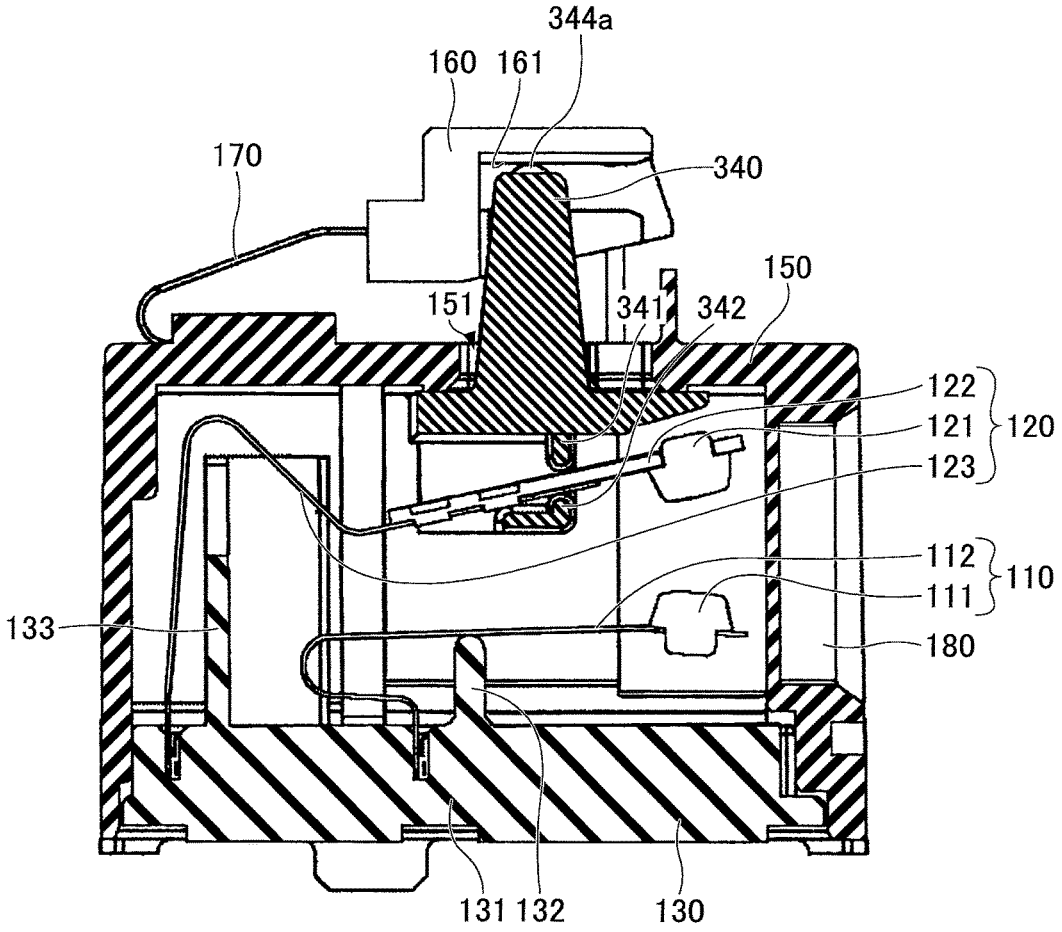
FIG. 40 is a structural view of a switch in a turn-off state of a third embodiment.
Figure 41:
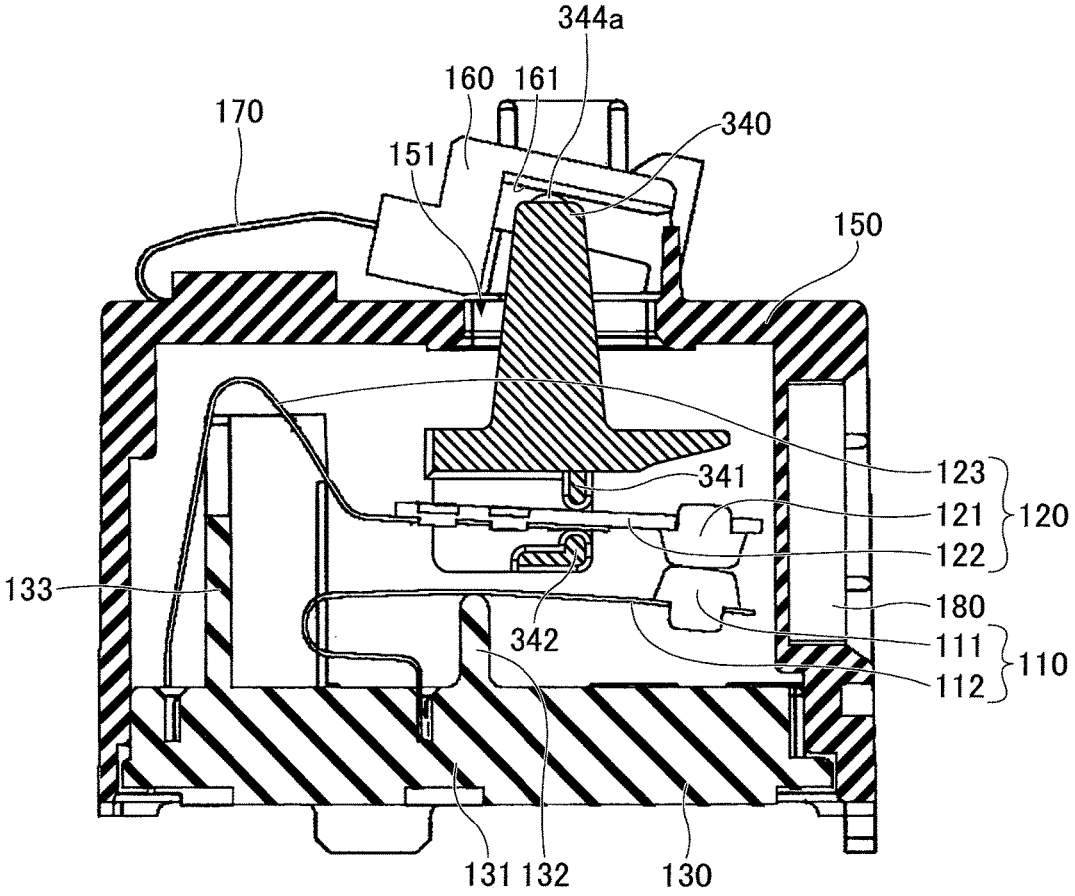
FIG. 41 is a structural view of the switch in the turn-on state of the third embodiment.

Referring to FIGS. 40 and 41, the switch of the third embodiment includes a card 340 having no rotating shaft. By pushing the button 160, the card 340 moves up or down to causing the fixed contact 111 of the fixed portion 110 to contact the movable contact 121 of the movable portion 120.

Specifically, by pressing the button 160, a contact portion 344*a* in contact with the button inner portion 161 of the button 160 is pushed. Thus, the card 340 moves downwardly. Then, an upper contact part 341 pushes the movable plate 122 downwardly to make the fixed contact 111 contact the movable contact 121. Thus, as illustrated in FIG. 41, the switch becomes the turn-on state. Under this state, in a manner similar to the second embodiment, a turn-on state retaining mechanism or the like (not illustrated) maintains the contact between the movable contact 121 and the fixed contact 111.

Further, when the turn-on state retaining mechanism or the like is released, restoring force of the swing spring 170 makes the switch be the turn-off state as illustrated in FIG. 40. Said differently, the lower contact part 342 of the card 340 pushes the movable plate 122 upwardly to release the contact between the fixed contact 111 and the movable contact 121. Because the upper contact part 341 and the lower contact part 342 slide on the movable plate 122, the surface layer made of the fluorine resin may be formed on the surfaces of the upper contact part 341 and the lower contact part 342 in order to reduce the friction resistance.

With the switch of the third embodiment, because the rotating shaft or the like is not provided in the card 340, the switch can be miniaturized.

The other portions of the third embodiment are similar to those described in the second embodiment. The switch of the third embodiment can be used as the switch portion of the connector of the first embodiment.

Fourth Embodiment

Figure 42:
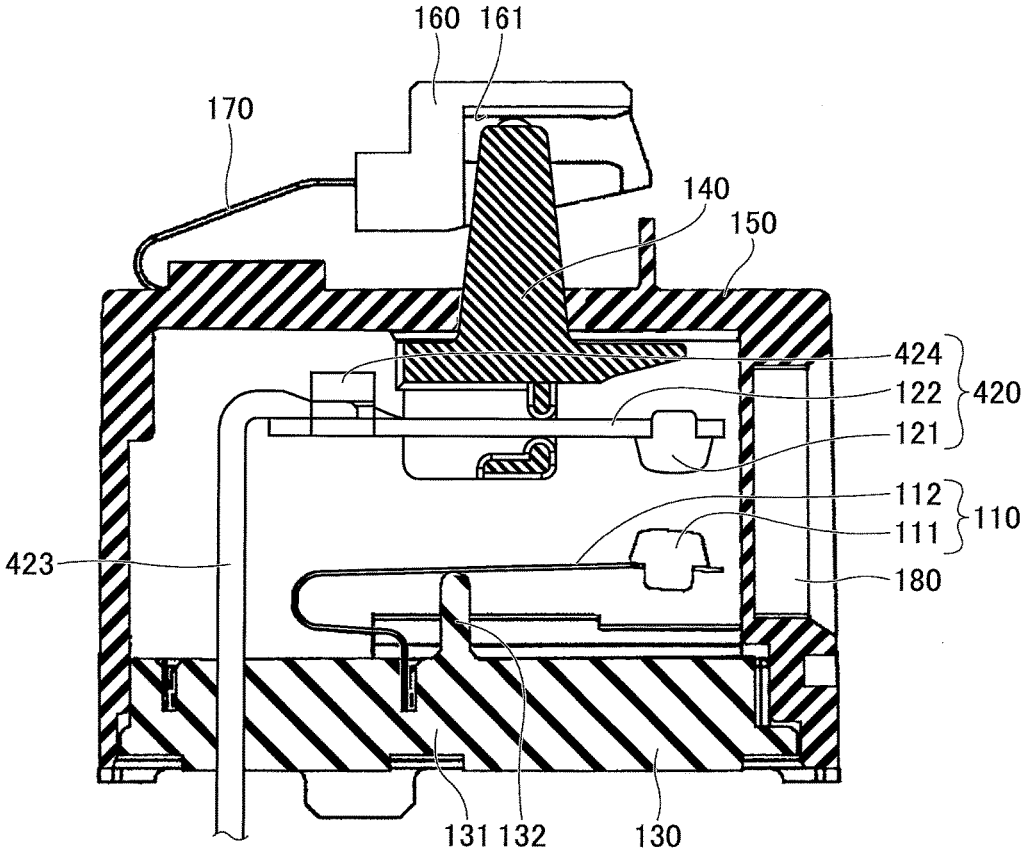
FIG. 42 is a structural view of a switch in a turn-off state of a fourth embodiment.
Figure 43:
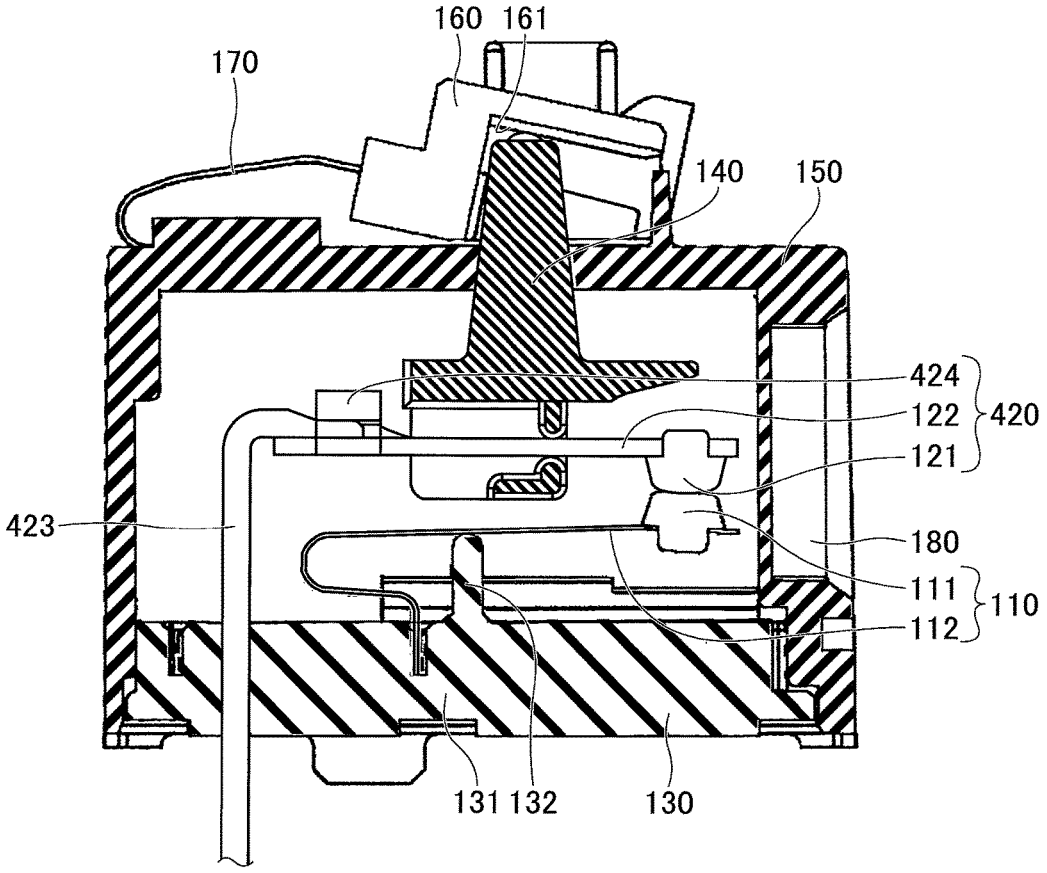
FIG. 43 is a structural view of the switch in the turn-on state of the fourth embodiment.
Figure 44:
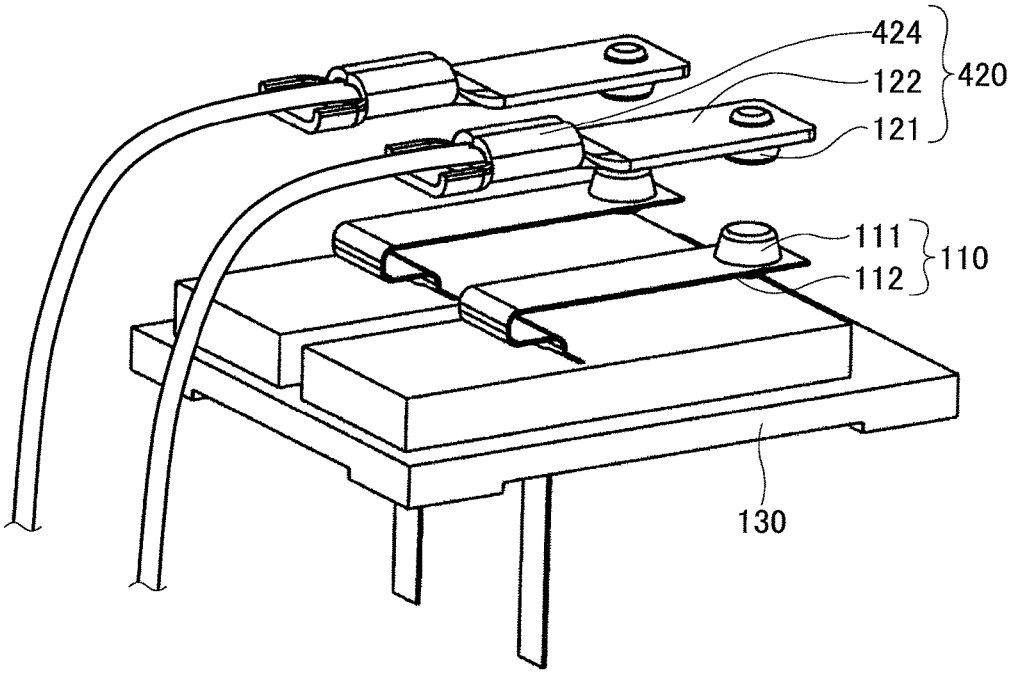
FIG. 44 is an explanatory view of the switch of the fourth embodiment.

Next, a switch of a fourth embodiment is described. In the switch of the fourth embodiment, the turn-off state is illustrated in FIG. 42, and the turn-on state is illustrated in FIG. 43.

In the switch of the fourth embodiment, a part of the movable spring 123 is formed by a cable 423, which is an electric wire. In the switch of the fourth embodiment, because the contact between the fixed contact 111 and the movable contact 121 are released by restoring force of the swing spring 170, spring property of the movable spring 123 or the like is not used. Therefore, the part corresponding to the movable spring 123 is formed by the cable 423. The cable 423 may be any as long as electric conductivity is given to. It is preferable to use a cable such as a woven cable because a flexible motion is obtainable. Further, coating may be provided on the surface of the cable 423. A part of the cable 423 having electric conductivity is connected to a terminal connecting portion 424 provided in the movable portion 420.

The other portions of the fourth embodiment are similar to those described in the second and third embodiments. The switch of the fourth embodiment can be used as the switch portion of the connector of the first embodiment.

According to the aspects of the present invention, it is possible to provide a connector for high voltage electric power higher than the voltage of a currently used commercial power source or for a direct current power source so that electric power is safely supplied from these power sources. Further, it is possible to provide a switch having better safety and better reliability for a high voltage power source having a voltage higher than the voltage of a currently used commercial power source or for a direct current power source.

All examples and conditional language recited herein are intended for pedagogical purposes to aid the reader in understanding the embodiments and the concepts contributed by the inventor to furthering the art, and are to be construed as being without limitation to such specifically recited examples and conditions, nor does the organization of such examples in the specification relate to a showing of superiority or inferiority of the embodiments. Although the connector has been described in detail, it should be understood that the various changes, substitutions, and alterations could be made hereto without departing from the spirit and scope of the invention.

What is claimed is:

1. A connector comprising:

a connection terminal to be connected to another connection terminal of another connector;

a fixed contact;

a movable contact being capable of contacting the fixed contact;

a slide portion;

a contact slide operated in association with a slide movement of the slide portion;

a button that is pushed in accordance with the slide movement of the slide portion, the button including a lower portion, an upper portion having a profile relatively higher than the lower portion, and a slant portion connecting the lower portion to an upper stage provided on its upper surface; and a card that moves the movable contact toward and away from the fixed contact in accordance with the movement of the button;

wherein a tip end of the contact slide contacts with the lower portion when the switch is in a turn-off state in which the movable contact is separated from the fixed contact, contacts with the slant portion so as to push the button and cause the card to move the movable contact toward the fixed contact when the slide portion is slid in one direction, and contacts with the upper portion when the switch is in a turn-on state in which the movable contact contacts with the fixed contact.

2. The connector according to claim 1, further comprising:

a slide linking portion that is operated in association with the slide movement of the slide portion, a part of the slide linking portion comes in contact with the contact slide, wherein, by sliding the slide portion, the slide linking portion moves substantially in parallel to a direction of sliding the slide portion, and when the contact slide is pushed by the slide linking portion, the contact slide moves substantially in parallel to the direction of sliding the slide portion.

3. A connector comprising:

a switch case;

a base block;

a connection terminal to be connected to another connection terminal of another connector;

a fixed contact located inside a region surrounded by the switch case and the base block;

a movable contact located inside the region surrounded by the switch case and the base block, and being capable of contacting the fixed contact;

a slide portion;

a button that is pushed down in accordance with a slide movement of the slide portion;

a card connected to the base block so as to be rotatable relative to the base block and is operated in accordance with the movement of the button; and a spring located outside the switch case, connected to the button and biasing the button to a direction of separating a contact between the fixed contact and the movable contact, wherein the button is pushed down and the card moves to cause the movable contact to contact the fixed contact when the slide portion is moved in one direction, and the button is moved by the spring and the card moves to cause the movable contact to be separated from the fixed contact when the slide portion moves in another direction opposite to the one direction.

4. A switch comprising:

a case;

a base block;

a fixed contact located inside a region surrounded by the case and the base block;

a movable contact located inside the region surrounded by the case and the base block and being capable of contacting the fixed contact;

a button that can be pushed down;

a card connected to the base block so as to be rotatable relative to the base block and is operated in accordance with the movement of the button so as to move the movable contact toward and away from the fixed contact; and a spring provided outside the case and firmly fixed to the button and to the case, and biasing the button to a direction to move the card to separate the movable contact from the fixed contact, wherein the card moves to cause the movable contact to contact the fixed contact when the button is pushed down.

5. The switch according to claim 4, wherein the card includes a portion disposed inside the case, the portion is configured to prevent dust intrusion into the casing in accordance with the movement of the button to move the movable contact away from the fixed contact, and wherein the case includes a cover portion disposed outside the case, the cover portion is configured to prevent the dust intrusion into the casing in accordance with the movement of the button to move the movable contact toward the fixed contact.

6. A switch comprising:

a case;

a base block;

a fixed contact located inside a region surrounded by the case and the base block;

a movable contact located inside the region surrounded by the case and the base block and being capable of contacting the fixed contact;

a card rotatably connected to the base block so as to move the movable contact toward and away from the fixed contact;

a button that can be pushed down, and causes the card to rotate relative to the base block; and a leaf spring comprised of a flat plate, connected to the button and to the case, and biasing the button to lift up the button from the case, wherein, when the button is pushed down, the button pushes down and rotates the card so as to push down the movable contact to contact the fixed contact, and when the button is lifted up and moves away from the case by the biasing force of the leaf spring, the button rotates and pulls the card upward so as to move up the movable contact away from the fixed contact.

* * * * *